US009574331B2

(12) United States Patent
Wright

(10) Patent No.: US 9,574,331 B2
(45) Date of Patent: Feb. 21, 2017

(54) SHOWER FLOW MONITOR AND DISPLAY

(71) Applicant: Kenneth McLeod Wright, Ventura, CA (US)

(72) Inventor: Kenneth McLeod Wright, Ventura, CA (US)

( * ) Notice: Subject to any disclaimer, the term of this patent is extended or adjusted under 35 U.S.C. 154(b) by 403 days.

(21) Appl. No.: 13/921,107

(22) Filed: Jun. 18, 2013

(65) Prior Publication Data

US 2013/0333764 A1 Dec. 19, 2013

Related U.S. Application Data

(60) Provisional application No. 61/661,306, filed on Jun. 18, 2012.

(51) Int. Cl.

| | |
|---|---|
| ***B05B 12/00*** | (2006.01) |
| ***E03C 1/02*** | (2006.01) |
| ***E03C 1/04*** | (2006.01) |
| *B05B 1/18* | (2006.01) |

(52) U.S. Cl.

CPC ..... *E03C 1/02* (2013.01); *E03C 1/0408* (2013.01); *B05B 1/18* (2013.01); *B05B 12/004* (2013.01); *E03C 2001/0418* (2013.01); *Y10T 137/0318* (2015.04); *Y10T 137/8158* (2015.04)

(58) Field of Classification Search

CPC ..... B05B 12/004; B05B 12/006; B05B 12/02; B05B 12/04

USPC .... 239/69–74, 67, 63; 4/675, 605, 601, 567, 4/570

See application file for complete search history.

(56) References Cited

U.S. PATENT DOCUMENTS

| | | | | |
|---|---|---|---|---|
| 4,936,506 | A | 6/1990 | Ryan | |
| 5,140,254 | A * | 8/1992 | Katzman | A47K 3/281 290/54 |
| 5,402,812 | A | 4/1995 | Moineau et al. | |
| 6,439,472 | B1 | 8/2002 | Lin et al. | |
| 6,899,133 | B2 | 5/2005 | Brunkhardt | |
| 6,997,064 | B2 | 2/2006 | Bird et al. | |
| 7,387,401 | B2 | 6/2008 | Clark | |
| 7,841,732 | B2 * | 11/2010 | Coushaine | F03B 13/00 362/192 |
| 7,948,831 | B2 | 5/2011 | Orcutt et al. | |
| 2003/0125842 | A1 | 7/2003 | Chang et al. | |
| 2004/0155116 | A1 * | 8/2004 | Wack | G05D 23/1393 236/12.12 |
| 2006/0283973 | A1 | 12/2006 | Bean, Jr. | |
| 2007/0126237 | A1 | 6/2007 | Liao et al. | |
| 2009/0242659 | A1 | 10/2009 | Metlen et al. | |

(Continued)

FOREIGN PATENT DOCUMENTS

| | | |
|---|---|---|
| AU | 200224600 B2 | 9/2009 |
| WO | WO 2004/106791 | 12/2004 |

OTHER PUBLICATIONS

Gigli, Matt et al., Smart Shower Project, USD ELEC 492, Mar. 22, 2011.

(Continued)

*Primary Examiner* — Arthur O Hall
*Assistant Examiner* — Tuongminh Pham
(74) *Attorney, Agent, or Firm* — Doug Larson

(57) ABSTRACT

A shower flow monitoring and display apparatus that is adapted to be installed inline between a shower arm and head. The apparatus provides different forms of feedback to the user to encourage water conservation.

5 Claims, 35 Drawing Sheets

(56) References Cited

U.S. PATENT DOCUMENTS

2011/0068192 A1* 3/2011 Klicpera ..... B05B 12/004
239/74

OTHER PUBLICATIONS alibaba.com, LED Shower Head, www.alibaba.com/showroom/led-shower-head.html, pp. 1-10, Copyright 1999-2013, printed Jun. 9, 2013.

Kzlidea, Patents Protected LED Hand Shower, www.kzildea.com/productsshow.asp?classid=30&d=37, Copyright 2006-20123, printed Jun. 19, 2013.

* cited by examiner

SHOWER FLOW MONITOR AND DISPLAY

CROSS REFERENCE TO RELATED APPLICATIONS

This application claims the benefit of provisional application Ser. No. 61/661,306, filed Jun. 18, 2012, and whose entire contents are hereby incorporated by reference.

BACKGROUND

As the demand for fresh water increases and the supplies of fresh water decrease, water conservation is becoming critically important in the United States, China and elsewhere in the world. Water shortages are more common, particularly in the Southwestern United States, due to a combination of rising temperatures, population growths, water waste and droughts, as well as a very large increase in water demand from commercial industries.

Personal showers are a major user of fresh water. An average shower lasts twelve minutes and uses 2.5 gallons of fresh water per minute. When that amount of water is multiplied by the number of people and the average number of showers per person per day, it is readily apparent that a tremendous quantity of fresh water is used every day for showering. Additionally, considerable energy is used in the pumping, heating and treatment of water in treatment facilities. Shortening the time spent showering dramatically reduces this energy. Thus, there is a continuing need to decrease the amount of shower water used, not only in personal households, but also in hotels, military bases, college campuses, apartment buildings, passenger ships and the like.

SUMMARY

Disclosed herein is a shower flow monitoring and display apparatus having a power unit (or a first unit, a recharging unit, a water flow path unit, or a water temperature sensing unit) and a display unit (or a second unit or a visual and audio display assembly unit). The apparatus can be operatively positioned between a water pipe and a shower head and thereby define a shower water flow path therebetween and through the power unit. The display unit can include a visual/audio display assembly; and the display unit can be connected to the power unit by a connection, such as a ball-and-joint connection, that allows a user to position the display assembly to a desired orientation relative to the power unit.

The power unit can include a thermistor which with the apparatus in place on and between a water pipe and a shower head and the shower water turned on, senses the temperature of the water in the water flow path. The thermistor can send temperature signals to a controller in the display unit. When the controller receives a temperature signal corresponding to a predetermined acceptable water shower temperature the controller can actuate a shower session of the display assembly by sending visual and/or audio signals alerting the user that the shower water is hot enough and that his timed shower session has begun.

The session can have a plurality of stages, each having a different audio and/or visual display from the display assembly and each following the previous one after the passage of a respective predetermined time period. The stages can include a shower stage, a rinse stage and a stop stage. And the stop stage can have a first part/phase followed by a second part/phase wherein the display of the second part/phase is more "urgent" than that of the first part/phase. The start of each stage or part can be signaled to the user by an audio and/or visual signal. And audio and/or visual signals corresponding to each stage or part can be displayed or sent to the user during each of the respective stages or parts, as he showers.

The display assembly (and the remote control) can be powered by a battery that is recharged by a hydroelectric power generator in the power unit and powered by water flowing in the flow path. Wires from the power generator can transmit the AC current to the display unit where it is converted by the controller to DC current, which recharges the battery. When the controller detects incoming electricity from the power generator it knows that the water to the power unit has been turned on and that, for example, it can start the shower session. Similarly, when the controller then detects no incoming electricity it knows that the water has been turned off and for example, it can end the shower session.

With reference to the hydroelectric power generator, a hydraulic turbine converts the energy of flowing water into mechanical energy and a hydroelectric generator converts this mechanical energy into electricity.

If the user tries to short cut the shower session by turning the water off early and then quickly turning it back on, the display assembly can send out an audio and/or visual alert. For example, if the user turns the water off before the stop stage of the shower session and then turns the water back on before a predetermined time period (e.g., three minutes) has passed, the display assembly emits an audio and/or visual alert. An example of this alert can be beeping sounds accompanied by blinking lights. Another example can be blinking lights accompanied by a voice message, such as "please exit the shower," "allotted shower time has been exceeded; please exit" or something similar. In other words, the alert "session" discourages a user from obtaining a long shower time by avoiding the full shower session, that is by avoiding the annoying the audio/visual signals of the stop stage.

A mute button can be provided on the display unit to allow a user to turn off the audio portion of the display assembly if he finds it unnecessary, annoying or distracting.

As mentioned above, the display unit can be attached to the power unit such that the display assembly, which can include an LCD panel, can be repositioned by the user as desired. The user may choose to reposition it, for example, because of his height or where he likes to stand (or sit) in the spray of a shower or in the shower stall. Repositioning the display assembly can include repositioning the entire display unit relative to the power unit. And the repositioning can be about a pivot axis and/or a rotational axis.

One connection that provides for the above-mentioned repositioning is a ball-and-socket joint with the ball portion attached to or part of the display unit and the socket portion attached to or part of the power unit, or vice versa. As an example, the display unit can include a lower housing portion having a ball lower portion and an upper housing portion having a ball upper portion. And the power unit can have upper and lower housing portions each having a respective upper and lower socket portion. The upper and lower housing portions of the display unit together with the upper and lower ball portions are snapped, screwed or otherwise attached together. With the assembled ball positioned in one of the upper and lower socket portions, the upper and lower housing portions of the display unit together with the upper and lower socket portions can be snapped, screwed or otherwise attached together, such that the ball is within the assembled socket. The display unit can thereby be rotated and/or pivoted relative to the power unit, as desired by the user. The housing portions can be releasably attached together so that a user can subsequently disassemble them to repair or replace internal components as may be needed.

The apparatus can be sold or otherwise made available to the user with the predetermined temperature and the shower session fixed, and/or with the predetermined temperature and/or shower session customizable by the user. One way of customizing is using a remote control unit that operatively connects to the controller via an IR sensor. Another way is to plug one end of a cord into a USB port of the display unit and the other end connected to a computer. With the computer accessing a website of this disclosure and synched with the controller, the user chooses by clicking on the appropriate areas on the page on the computer monitor the desired water shower temperature, the lengths of the wash, rinse and stop (first phase) stages, the audio selections for each of the stages, and/of the blinking and/or beeping rates for the alert session.

More particularly, with the computer accessing the website and synched up to the apparatus and its internal controller, the user can re-program the factory settings of the controller. The apparatus can be synched up via the USB port. Thereby, the user can program the desired starting temperature, the duration of the shower stage, the duration of the rinse stage, and the duration of the stop "grace" period phase. Using the computer/device interface, the user can also select and re-program the factory set audio alerts, selecting from a list of sound effects and volumes. These sound effects and/or voice recordings can be used to alert the user that a) the shower temperature has been reached, b) the shower time is up, transition to the rinse stage, c) the rinse time is up, transition to the stop stage, and/or d) the grace period is over, turn the water off and exit the shower.

According to one definition of the present disclosure a shower flow monitoring and display apparatus having a first unit and a second unit extending out from it is disclosed. The apparatus can be positioned between a water pipe and a shower head with a flow path through the first unit. The second unit can be repositioned in rotational and/or pivotal directions by a user with the power unit in place and about a ball-and-socket joint. A hydroelectric power generator in the first unit recharges the battery of the second unit and also lets the controller in the first unit know when the water has been turned on and off. A thermistor in the first unit lets the controller know when the water has reached a predetermined temperature and the shower session thereby can begin. The session can include shower, rinse and stop part one and stop part two stages. Each of the stages includes corresponding visual and/or audio signals to the user from a display assembly of the display unit. If the user turns the water off before the stop part one stage and then turns it back on before a predetermined time period has lapsed, an alert stage/mode is started. Connecting the controller to a website of the disclosure allows a user to customize the visual and/or audio signals. Alternatively, customization can be done using a remote control unit.

1. Disclosed herein is a shower apparatus which comprises: a power unit which includes: a water supply inlet adapted to be positioned in fluid communication with a water pipe; a water supply outlet adapted to be positioned in fluid communication with a shower head; and a water path between the inlet and the outlet; and a display unit which: is connected to the power unit; extends out from the power unit; has a display assembly configured to convey to a user information concerning water flowing in the water path; and receives electricity from the power unit.

1a. The apparatus of 1 wherein the user is a user of water from the shower head, and the display assembly is configured to convey the information when water is flowing into the power unit from the water pipe.

1b. The apparatus of 1 wherein the shower head is orientation and spray adjustable by the user when attached to the water supply outlet.

1c. The apparatus of 1 wherein the shower head includes an elongate flexible hose and a shower nozzle at a distal end of the hose.

1d. The apparatus of 1 further comprising a connector connecting the display unit to the power unit and configured to allow the display unit to move in both rotational and pivotal directions relative to the power unit.

1e. The apparatus of 1d wherein the connector includes a ball-and-socket joint.

1f. The apparatus of 1e wherein the ball-and-socket joint includes a ball connected to a post extending out from a housing of the display unit and a socket extending out from a housing of the power unit and in which the ball is rotatably positioned.

1g. The apparatus of 1f wherein the socket includes first and second portions on opposite sides of the ball and fastened together.

1h. The apparatus of 1e wherein: the ball-and-socket joint includes a first socket portion which is part of a power unit first housing portion, a second socket portion which is part of a power unit second housing portion, a first ball portion which is part of a display unit first housing portion, and a second ball portion which is part of a display unit second housing portion; and wherein the power unit first and second housing portions are configured to be attached together with the first and second ball portions attached together and the attached ball portions positioned between the first and second socket portions.

1i. The apparatus of 1e wherein at least one wire passes from the power unit to the display unit and through the ball-and-socket joint.

1j. The apparatus of 1e wherein the at least one wire passes through the ball of the ball-and-socket joint.

1k. The apparatus of 1j wherein the power unit includes a water temperature sensor, the display unit includes a printed circuit board assembly and the at least one wire includes a wire operatively connecting the water temperature sensor to the printed circuit board assembly.

1l. The apparatus of 1k wherein the power unit includes a hydroelectric power generator, the display unit includes a microcontroller and the at least one wire includes a wire operatively connecting the generator to the microcontroller.

1m. The apparatus of 1k wherein the generator has a generally round shape and is generally two inches in diameter and generally 1.5 inches thick.

1n. The apparatus of 1 wherein the display assembly is configured to convey at least some of the information visually to the user.

1o. The apparatus of 1 wherein the display assembly is configured to convey at least some of the information audibly to the user.

1p. The apparatus of 1 wherein the display assembly includes a liquid crystal display that includes graphic and/or alphanumeric symbols.

1q. The apparatus of 1p wherein the symbols include at least one shower symbol which is illuminated during a shower stage of a shower session of the apparatus, at least one rinse symbol which is illuminated during a subsequent rinse stage of the shower session and at least one stop symbol which is illuminated during a subsequent stop stage of the shower session.

1r. The apparatus of 1q wherein the display assembly includes audio prompts that alert the user to a transition from the shower session to the rinse stage and from the rinse stage to the stop stage and to the start of the stop stage.

1s. The apparatus of 1r wherein the display assembly includes a series of audio prompts that are more extreme during a second phase of the stop stage than during a first phase of the stop stage.

1t. The apparatus of 1s wherein the more extreme includes more frequent and/or louder audible prompts.

1u. The apparatus of 1q wherein the stop stage has a first part and a subsequent second part after a predetermined time period, and the display assembly has a first visual and/or audio display during the first part and a different second visual and/or audio display during the second part.

1v. The apparatus of 1u wherein the second visual and/or audio display includes a continuous blinking of at least one light, and the predetermined time period is between thirty seconds and one hundred and twenty seconds.

1w. The apparatus of 1 wherein the display assembly has a plurality of stages during a shower session including a final stop stage, and the display assembly has a visual and/or audio alert display which commences in the event that the water to the apparatus is turned off before the start of the stop stage and turned back on before a predetermined time period has elapsed.

1x. The apparatus of 1w wherein a hydroelectric power generator in the power unit sends a first signal to the display unit when the water to the apparatus has been turned off and a second signal when the water has been turned on.

1y. The apparatus of 1 wherein the power unit includes: a housing; a back nipple at a back of the housing and configured to operatively connect to the water pipe; a front nipple at a front of the housing and configured to operatively connect to the shower head; and a hydroelectric power generator in the housing and powered by water passing along the water path.

1z. The apparatus of 1 wherein the power unit includes a temperature sensor positioned to sense the temperature of water in the water path and the display unit is configured to commence a shower session upon receipt of a temperature signal from the sensor indicating that the water in the water path has reached a predetermined shower temperature.

1aa. The apparatus of 1z wherein the display unit includes a printed circuit board assembly.

1bb. The apparatus of 1z wherein an audio and/or visual commencing signal from the display unit alerts the user that the shower session of the apparatus has started.

1 cc. The apparatus of 1z wherein the shower session includes: a shower stage with the display unit having a shower stage display; followed after a first predetermined time by a rinse stage and with the display unit having a rinse stage display; and followed after a second predetermined time by a stop stage with the display unit having a stop stage display.

1 dd. The apparatus of 1 cc wherein each of the displays includes a visual and/or audible display.

1ee. The apparatus of 1cc wherein the stop stage includes a preliminary stop visual and audio display for a predetermined time and then a second phase visual and audio display.

1ff. The apparatus of 1ee wherein the predetermined time is approximately one minute and the second phase visual and audio stop display includes a continuous beeping sound or repeating message.

1gg. The apparatus of 1 wherein the power unit includes a water temperature sensor and the display unit includes a microcontroller which is configured to cause the display assembly to start a display for a timed shower session upon receipt of an indication from the sensor that water in the water path has reached a predetermined temperature corresponding to an acceptable water shower temperature.

1hh. The apparatus of 1gg wherein the predetermined temperature is adjustable using a remote control and/or an electronic device which is connectable to the display unit, such as via an electrical cord.

1ii. The apparatus of 1hh wherein the electronic device is communicable to a website that provides for a user to adjust at least the predetermined temperature.

1jj. The apparatus of 1ii wherein the website provides for a user to adjust the lengths of stages of the shower session.

1kk. The apparatus of 1gg wherein the shower session includes a shower stage, a rinse stage and a stop stage.

1ll. The apparatus of 1kk wherein the shower stage lasts between five and seven minutes and the rinse stage lasts between forty-five seconds and ninety seconds.

1mm. The apparatus of 1kk wherein the only way to end the stop stage without disconnecting the apparatus is to stop the water flowing in the water flow path.

1nn. The apparatus of 1kk wherein turning the water off stops the shower session by sending a signal from a hydroelectric power generator to the controller.

1oo. The apparatus of 1kk wherein the display includes an audible signal at the start of the shower stage, an audible signal at the start of the rinse stage and audible stop signals during the stop stage.

1pp. The apparatus of 1oo wherein the audible stop signals continue until water flow to the water flow path is turned off.

1qq. The apparatus of 1kk wherein the display assembly includes: during the shower stage the word "shower," a shower bubbles image and a smile symbol being illuminated; during the rinse stage a stop watch symbol, the word "rinse" and a rinse off symbol being illuminated; and during the stop stage a frown symbol, the word "stop," and an open stop hand image being illuminated.

1rr. The apparatus of 1kk wherein the lengths of the shower and rinse stages are adjustable by a user.

1ss. The apparatus of 1kk wherein the audible signals of the display assembly are adjustable by a user.

1tt. The apparatus of 1 wherein the orientation of the display unit relative to the power unit is manually repositionable by a user in both rotational and pivotal directions with the power unit connected to the water pipe.

1uu. The apparatus of 1 wherein the display includes an LCD and a color bar, and the color bar includes a plurality of LEDs and embedded imagery.

1vv. The apparatus of 1 wherein the display unit includes a USB port via which a user can customize the display assembly.

1ww. The apparatus of 1 wherein the display assembly includes an audio temperature signal indicating that the water in the flow path has reached a predetermined acceptable shower water temperature and the shower session has started and the display assembly includes an audio time signal indicating that at least a predetermined shower time in the showering session in the shower session has past since the audio temperature signal commenced.

1xx. The apparatus of 1ww wherein the display assembly includes a visual temperature signal indicating that the water in the flow path has reached a predetermined acceptable shower water temperature and the display assembly includes a visual "stop" signal indicating that the predetermined shower time has elapsed since the visual temperature signal commenced.

1yy. The apparatus of 1ww wherein the display assembly includes an audio temperature signal indicating that the water in the flow path has reached a predetermined acceptable shower water temperature and the shower session has thereby started and the display assembly includes an audio "stop" signal indicating that a predetermined shower time of the shower session has elapsed.

1zz. The apparatus of 1 wherein the display unit includes an infrared sensor which is configured to receive signals from a remote control which allows a user to re-program the controller or printed circuit board assembly to change the volume, duration and/or sound of the audio signals, to change the times of at least one of the stages of a shower session of the apparatus and/or to change the water temperature setting of the start of the shower session.

1aaa. The apparatus of 1zz wherein the remote control has a first button for adjusting the volume of an audible display, a second button for adjusting the length of a shower stage of the session, a third button for adjusting the length of a rinse stage of the session, a fourth button for adjusting the length of a stop stage of the session, and a fifth button for a sound "off" mute.

1bbb. The apparatus of 1 wherein the power unit includes a housing, a back nipple at the inlet, a front inlet at the outlet, and a hydroelectric power generator in the housing and powered by water flowing in the flow path.

1ccc. The apparatus of 1bbb wherein the back nipple has internal threads and the front nipple has external threads.

1ddd. The apparatus of 1 wherein the display assembly includes pre-recorded audio messages sounding at predetermined time intervals during a shower session of the apparatus.

1eee. The apparatus of 1 wherein the display assembly includes an LCD that includes a color bar.

1fff. The apparatus of 1eee wherein the color bar includes three vertically arranged lights that include a green light at the top, a yellow light in the middle and a red light at the bottom.

1ggg. The apparatus of 1 wherein the display unit is configured to operatively connect to an external device through which the display assembly can be adjusted.

1hhh. The apparatus of 1ggg wherein the external device is a laptop or tablet computer.

1iii. The apparatus of 1ggg wherein the display assembly is configured to be modified through the device by creating a personalized audio message that the display unit sounds out at a predetermined time in a shower session.

1jjj. The apparatus of 1ggg wherein the external device is a remote control.

1kkk. The apparatus of 1ggg wherein the external device is a computer that can access a website via which the audio message can be created or changed.

1lll. The apparatus of 1 wherein the display unit includes a printed circuit board assembly and at least one user control, which includes a mute button that is operatively connected to the printed circuit board assembly.

1mmm. The apparatus of 1 wherein the power unit has a first rectangular prism shape with a first width, a first length and a first thickness, the display unit has a second rectangular prism shape with a second width, a second length and a second thickness, wherein the first thickness is greater than the second thickness, and the second length is greater than the first length.

1nnn. The apparatus of 1mmm wherein the first width and the second width are within generally 15% of each other.

1ooo. The apparatus of 1mmm wherein the power unit includes a first nipple extending out a rear face of the first rectangular prism shape and a second nipple extending our a front face of the second rectangular prism shape.

1ppp. The apparatus of 1mmm wherein the power unit has a ball extending out from a side of the first rectangular prism shape and the display unit has a socket extending out from an adjacent side of the second rectangular prism shape and fitting on to the ball to form a ball-and-socket joint.

1qqq. The apparatus of 1ppp wherein wires pass through the ball of the ball-and-socket joint between the power unit and the display unit.

1rrr. The apparatus of 1mmm wherein the power unit has a plurality of elastomeric plugs on a back side thereof and positioned on fasteners that hold two parts of the power unit housing together.

1sss. The apparatus of 1 further comprising a pivot/rotation joint connecting the display unit to the power unit.

1ttt. The apparatus of 1 wherein the display unit includes a printed circuit board assembly having the following components: a capacitor, a plurality of LEDs, a resister, an IR receive sensor, a DC-to-DC regulator, at least one battery charging control chip and a PIN slot connector.

1uuu. The apparatus of 1ttt wherein the printed circuit board assembly includes a circuit test button and/or an MUC.

1vvv. The apparatus of 1 wherein the display unit has a button positioned to be actuated by a user to turn off or mute the audible signals of the display assembly.

1www. The apparatus of 1 wherein the display unit includes a rechargeable 3.7 Volt lithium ion battery.

1xxx. The apparatus of 1 wherein the display unit includes a USB connector adapted to connect to a USB cable for customizing a display regimen.

1yyy. The apparatus of 1 wherein the display unit includes a printed circuit board assembly and the power unit includes a thermistor connected to the printed circuit board assembly by one or more wires.

1zzz. The apparatus of 1 further comprising wiring between the power unit and the display unit, and wherein: the power unit includes a hydroelectric power generator which is powered by water flowing along the path and which generates alternating current; the display unit includes a battery, the display assembly, and a printed circuit board assembly having a rectifier and a filter circuit; the wiring transmits the alternating current to the printed circuit board assembly which converts the alternating current to direct current and the direct current recharges the battery; and the battery provides electricity to the display assembly.

1aaaa. The apparatus of 1 wherein the power unit includes a thermistor that has different resistance values in different water temperatures, the display unit includes a microcontroller and the display assembly, and the different resistance values when actuated cause the microcontroller to instruct the display assembly to take different actions.

1bbbb. The apparatus of 1 wherein: the power unit includes: a hydroelectric power generator that is driven by water flowing in the water path; and a temperature sensor positioned for sensing temperature of water in the water path; the display unit includes: a controller that receives electricity from the generator and temperature signals from the temperature sensor and that controls the stages of a shower session; and the display assembly includes at least one differently colored light for each of the stages, and a speaker that emits an audible signal for each of the stages.

1 cccc. The apparatus of 1bbbb wherein the controller controls the operation of the display assembly.

1dddd. The apparatus of 1bbbb wherein the at least one colored light includes at least two LED lights.

1eeee. The apparatus of 1 wherein the display unit includes a battery, a battery charge control circuit and a bridge rectifier between the power unit and the battery charge control circuit, and the display assembly includes an audio circuit and an LED display circuit.

1ffff. The apparatus of 1 wherein the power unit includes a hydroelectric power generator that generates three-phase AC by water flowing in the water path and the display unit includes circuits that rectify, filter and stabilize the AC to 5V DC.

1gggg. The apparatus of 1 wherein the power unit includes a housing made of ABS plastic and the display unit includes a housing made of ABS plastic.

1hhhh. The apparatus of 1 wherein the power unit includes a hydroelectric power generator that includes an impeller and a dynamo.

2. Disclosed herein is a shower apparatus which comprises: a power portion including: a water supply inlet adapted to be positioned in fluid communication with a water pipe; a water supply outlet adapted to be positioned in fluid communication with a shower head; a water path between the inlet and the outlet; and a temperature sensor positioned to sense temperature of water in the water path; and a display portion including a controller and a display assembly; wherein the controller is configured to cause the display assembly to commence a shower session having a plurality of stages when the controller receives a signal from the sensor indicating that the water has reached a predetermined showering temperature, and is configured to cause the display assembly to send out at least one visual and/or audible signal to alert a user that the water has reached the acceptable temperature and that the shower session is thus commencing.

2a. The apparatus of 2 wherein: the power portion includes a power unit housing having a socket; the display portion includes a display unit housing having a display panel and a ball; and the ball is fitted in the socket to define a ball-and-socket joint that allows the pivotal and rotational movement of the display unit housing relative to the power unit housing to reposition the display panel relative to the user.

2b. The apparatus of 2a further comprising a thermistor wire operatively connecting the thermistor to the controller and passing through the ball.

2c. The apparatus of 2a wherein the power portion includes a hydroelectric power generator powered by water flowing in the water path, and further comprising a power wire passing from the generator, through the ball and to a circuit board for the display assembly.

2d. The apparatus of 2 wherein the temperature sensor is a thermistor.

2e. The apparatus of 2 wherein the shower session includes a delay of three or more minutes prior to commencement of a subsequent shower session.

3. Disclosed herein is a shower apparatus which comprises: a flow portion including: a water supply inlet adapted to be positioned in fluid communication with a water pipe; a water supply outlet adapted to be positioned in fluid communication with a shower head; and a water flow path between the inlet and the outlet; and a display portion attached to the flow portion and including a controller, a display assembly and a battery; wherein the controller is configured to cause the display assembly to start a shower session after shower water has been turned on; wherein the shower session has a plurality of stages including a final stop stage; and wherein the display assembly is configured to include an visual and/or audio alert display which commences in the event that water to the flow portion is turned off during the shower session and before the start of the stop stage and turned back on before a predetermined time period has elapsed.

3a. The apparatus of 3 wherein the flow portion includes a hydroelectric power generator that is driven by water flowing in the water flow path, and wherein the battery is recharged by electricity generated by the generator.

3b. The apparatus of 3a wherein the controller knows that the water has been turned off when the controller is no longer receiving electricity from the generator and the controller knows that the water has been turned on when the controller receives electricity from the generator.

3c. The apparatus of 3 wherein the visual and/or audio alert display includes a blinking stop signal and a repeating audio alert signal.

3d. The apparatus of 3 wherein the power portion includes a thermistor positioned to sense temperature of water in the water flow path and to send signals to the controller indicating the sensed temperature; and wherein the controller causes the shower session to start when the controller receives a signal from the thermistor that corresponds to a predetermined acceptable shower water temperature.

3e. The apparatus of 3d wherein the controller at the start of the shower session causes the display assembly to emit a visual signal and/or an audible signal to alert the user to the start of the shower session.

3f. The apparatus of 3 wherein the battery is a rechargeable 3.7 Volt lithium ion battery.

3g. The apparatus of 3 wherein the predetermined time period is between two and fifteen minutes.

4. Disclosed herein is a shower apparatus which comprises: a first unit which includes a water flow path adapted when the first unit is in position to provide a water flow path from a water supply source to an inlet of a shower head, and a hydroelectric power generator driven by water flowing in the water flow path; a second unit which includes a face that has at least one visual and/or audio indicator related to one or more stages of a shower session of the apparatus; wherein one of the first and second units includes a battery for powering the at least one visual and/or audio indicator; wherein at least one of the first and second units includes a battery charging circuit configured to recharge the battery using electricity from the generator; and wherein the face is repositionable relative to the first unit by a shower user and with the first unit in the position.

4a. The apparatus of 4 wherein the hydroelectric power generator includes a hydraulic turbine that converts the energy of water flowing in the path into mechanical energy and a hydroelectric generator that converts the mechanical energy into AC.

4b. The apparatus of 4 wherein the second unit is connected to the first unit by a ball-and-socket joint.

4c. The apparatus of 4 wherein the at least one visual and/or audio indicator includes an LCD and a speaker.

4d. The apparatus of 4 wherein the second unit includes the battery and the battery charging circuit.

5. Disclosed herein is a shower apparatus which comprises: a water flow path adapted when the apparatus is in position to provide a water flow path from a water supply source to a shower head; an audio and/or visual display assembly; and a controller configured to control the audio and/or visual display assembly through a shower session having at least a shower stage and a stop stage and to send at least one audio and/or visual alert signal from the audio and/or visual display assembly to a user in the event that water in the flow path is turned off during the shower session and before the start of the stop stage and subsequently turned back on before a predetermined time period has passed.

5a. The apparatus of 5 further comprising: a rechargeable battery for powering the audio and/or visual display assembly; and a hydroelectric power generator powered by water flowing in the water flow path and generating electricity to recharge the battery.

5b. The apparatus of 5a further comprising a recharging circuit between the generator and the battery and converting AC to DC.

5c. The apparatus of 5b wherein the recharging circuit includes a circuit board.

5d. The apparatus of 5 wherein the water flow path is part of a first unit and the audio and/or visual display assembly is part of a second unit, and the second unit is repositionable with respect to the first unit by a shower user with the apparatus in an operative position.

5e. The apparatus of 5d wherein a ball-and-socket joint connects the second unit and the first unit together and allows for the repositioning.

5f. The apparatus of 5 wherein the audio and/or visual display assembly delivers at least one audio signal during the shower session, and further comprising a mute button configured such that the user can cause the at least one audio signal to be turned off.

6. Disclosed herein is a shower stage indication process which comprises: providing a start indication to a shower user indicating that a shower session has started; providing a first indication to the shower user that the shower session is in a first stage thereof; providing a second indication to the shower user that the shower session is in a second stage thereof; providing a first stop indication to the shower user that the shower session is in a first phase of a stop stage of the shower session; providing a second stop indication to the shower user that the shower session is in a second phase of the stop stage; wherein the second stop indication is a more urgent indication than the first stop indication; wherein each of the indications is a visual and/or audible signal; and wherein the second stop indication includes beeping sounds and/or flashing lights.

6a. The process of 6 wherein the visual and/or audible signals emanate from an apparatus operatively positioned between a shower pipe and a shower nozzle.

6b. The process of 6 wherein the indications stop when the shower water is turned off.

6c. The process of 6 wherein the first and second stop indications include a stop symbol being illuminated.

7. Disclosed herein is a shower stage indication programming process which comprises: operatively connecting a controller of a shower apparatus to a computing device; wherein the shower apparatus includes: a water flow path adapted when the apparatus is in position to provide a water flow path from a water supply source to an inlet for a shower head; an audio and visual display assembly; and the controller; wherein the controller is configured to control the audio and visual display assembly through a shower session having at least a shower stage and a stop stage and with the apparatus in position; and with the computing device connected to a website, programming the controller by setting at least some of the audio displays and the visual displays through the website.

7a. The process of 7 wherein the operatively connecting uses a cable.

7b. The process of 7 wherein the shower session includes the shower stage, a subsequent rinse stage and the stop stage which is after the rinse stage, wherein the stop stage has a first stop session and a second stop session; and wherein the shower stage has a first time duration, the rinse stage has a second time duration and the first stop session has a third time duration.

7c. The process of 7b wherein the programming includes setting the first, second and third time durations.

7d. The process of 7b wherein the audio displays includes a first audio sound at the start of the shower stage, a second audio sound at the start of the rinse stage, and a third audio sound at the start of the first stop session; and the programming includes setting the first, second and third audio sounds.

7e. The process of 7b wherein the second stop session includes a repeating sound; and the programming includes selecting the repeating sound.

7f. The process of 7b wherein the controller causes the audio and visual display assembly to be activated into an alert mode session in the event that the water to the water flow path is turned off before the start of the first stop session and the water is subsequently turned back on before the passage of a predetermined time period.

7g. The process of 7f wherein the programming includes setting the predetermined time period.

7h. The process of 7f wherein the predetermined time period is generally three minutes.

7i. The process of 7f wherein the apparatus includes a hydroelectric power generator powered by water flowing in the water flow path and generating electricity which flows to the controller.

7j. The process of 7i wherein the apparatus includes a battery for powering the visual and audio display assembly and the controller converts the AC from the generator to DC which is delivered to the battery to recharge it.

7k. The process of 7i wherein electricity being delivered to the controller is a signal that water is flowing in the water flow path and electricity not being delivered to the controller is a signal that water is not flowing in the water flow path.

7l. The process of 7 wherein the shower apparatus includes a temperature sensor configured to sense temperature of water in the shower water path and to communicate the sensed water temperature to the controller; wherein the shower session is started when the controller receives a signal from the temperature sensor indicating that the water has reached a predetermined temperature; and wherein the programming includes setting the predetermined temperature.

8. Disclosed herein is a shower apparatus, comprising: a first unit which includes: a water supply inlet adapted to be positioned in fluid communication with a water pipe; a water supply outlet adapted to be positioned in fluid communication with a shower head; and a water flow path between the inlet and the outlet; a second unit which has a display assembly configured to convey to a user information concerning water flowing in the water flow path; and wherein a ball-and-socket joint connects the second unit to the first unit and is configured to allow the second unit to move in both rotational and pivotal directions relative to the first unit.

8a. The apparatus of 8 wherein: the ball-and-socket joint includes a first socket portion which is part of a first housing portion of the first unit, a second socket portion which is part of a second housing portion of the first unit, a first ball portion which is part of a first housing portion of the second unit, and a second ball portion which is part of a second housing portion of the second unit.

8b. The apparatus of 8a wherein the first and second housing portions of the first unit are configured to be attached together with the first and second ball portions attached together and the attached ball portions positioned between the first and second socket portions.

8c. The apparatus of 8 wherein at least one wire passes from the power unit to the display unit and through the ball-and-socket joint.

8d. The apparatus of 8 wherein the at least one wire passes through the ball of the ball-and-socket joint.

8e. The apparatus of 8d wherein the at least one wire includes a wire from a hydroelectric power generator in the first unit to a printed circuit board assembly in the second unit.

8f. The apparatus of 8d wherein the at least one wire includes a wire from a water temperature sensor in the first unit to a printed circuit board assembly in the second unit.

Also disclosed herein are novel packaging constructions for the apparatus.

BRIEF DESCRIPTION OF DRAWINGS

The drawings described herein are for illustrative purposes only of selected aspects of the present teachings and not all possible implementations, and are not intended to limit the scope of the present teachings.

DETAILED DESCRIPTION

Figure 1:
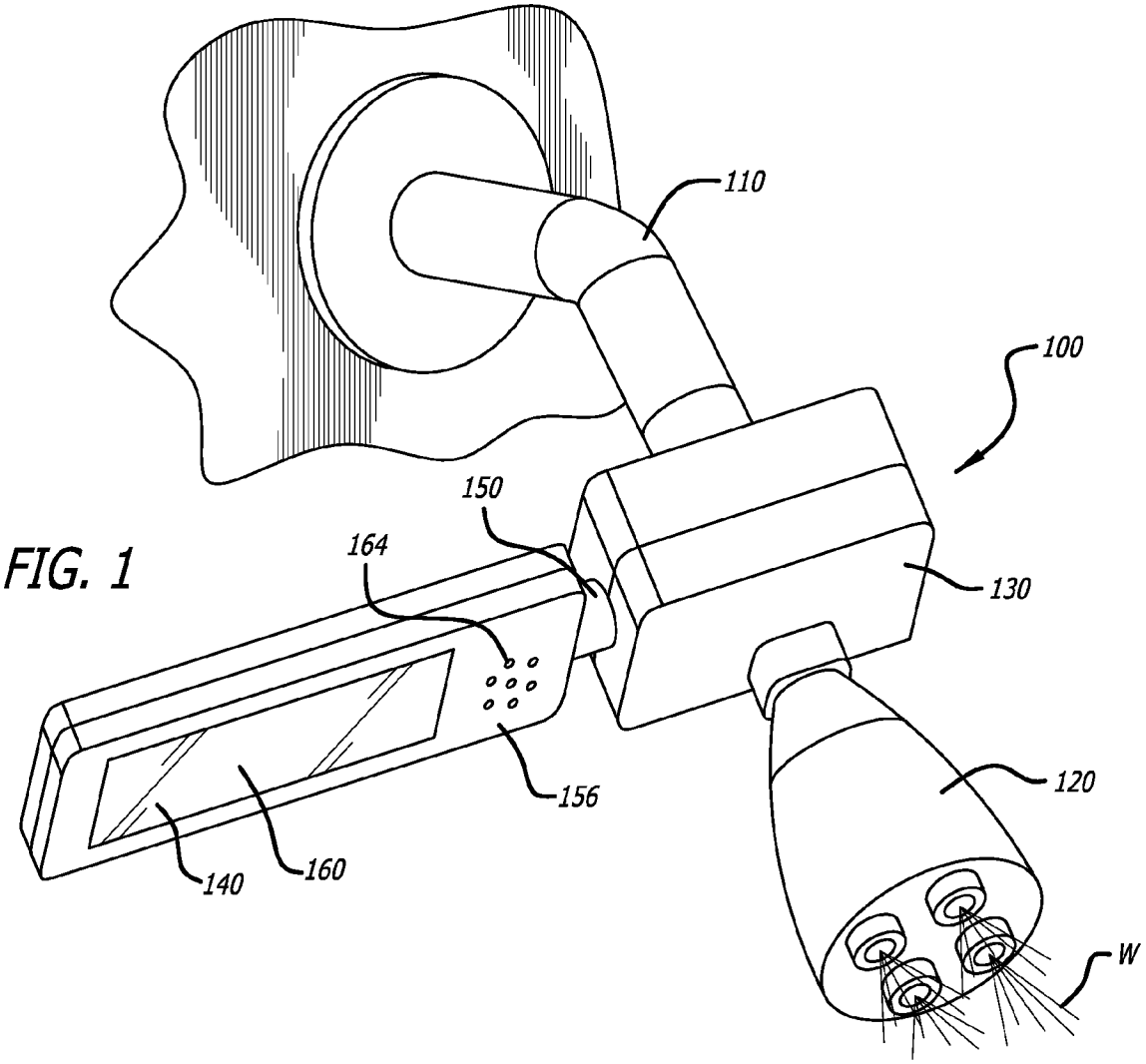
FIG. 1 is a perspective view of an apparatus of the present disclosure shown in an installed position relative to a water pipe and a shower head and spraying water.
Figure 2:
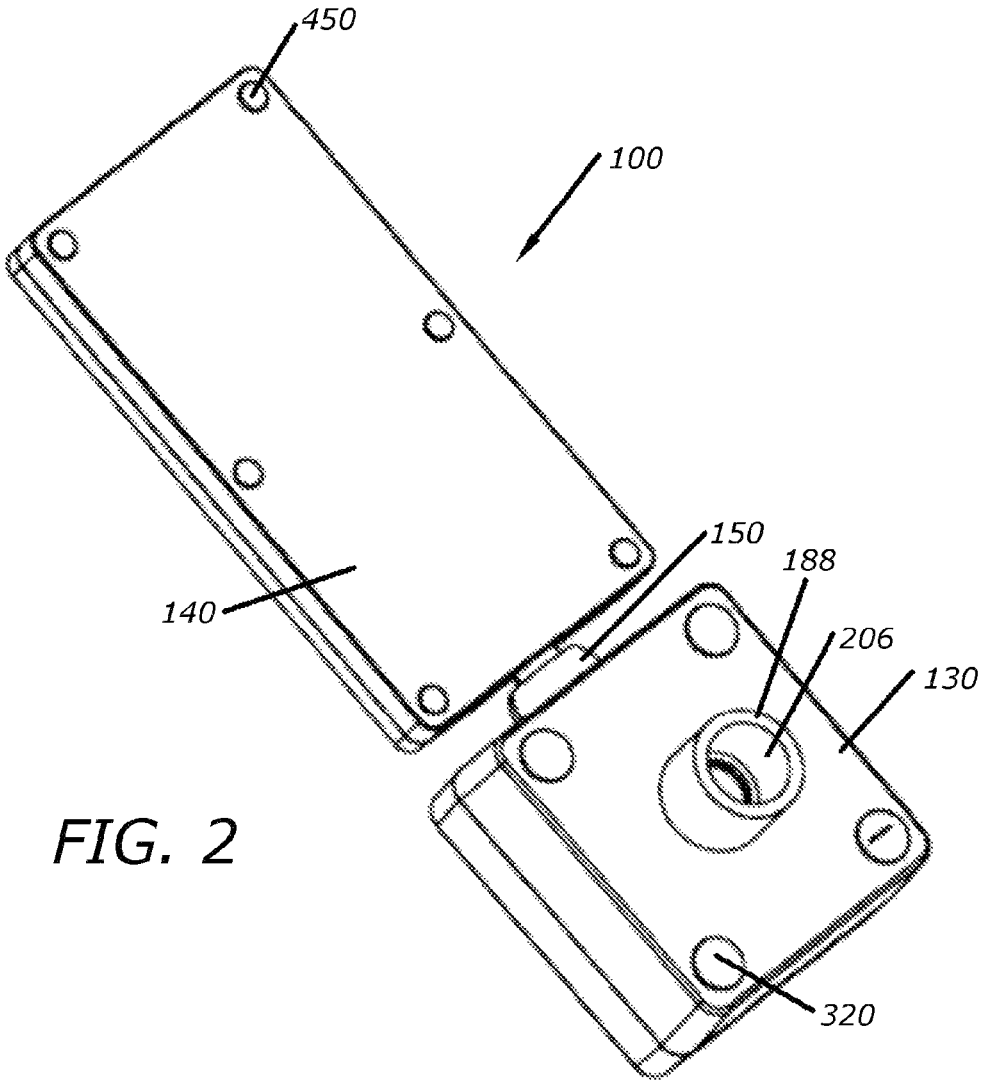
FIG. 2 is a rear perspective view of the apparatus of FIG. 1 in isolation.
Figure 3:
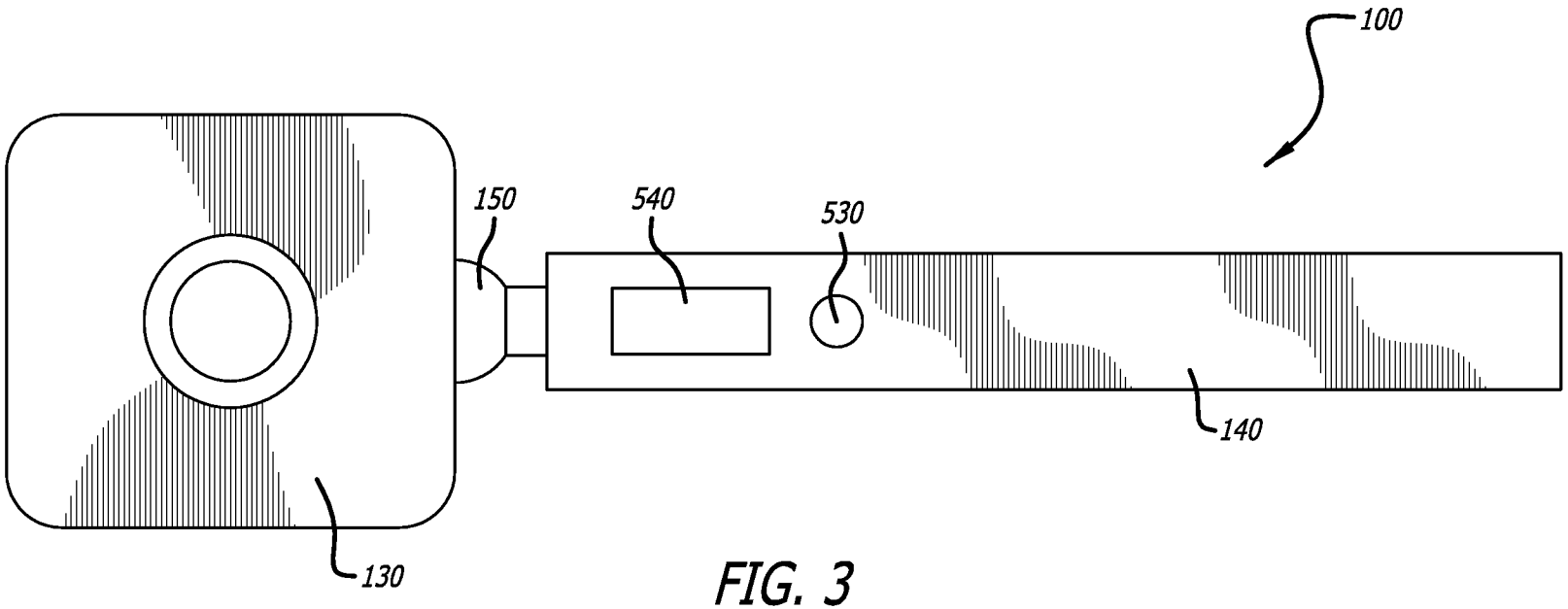
FIG. 3 is a top perspective view showing the connection of the display unit to the power unit.
Figure 4:
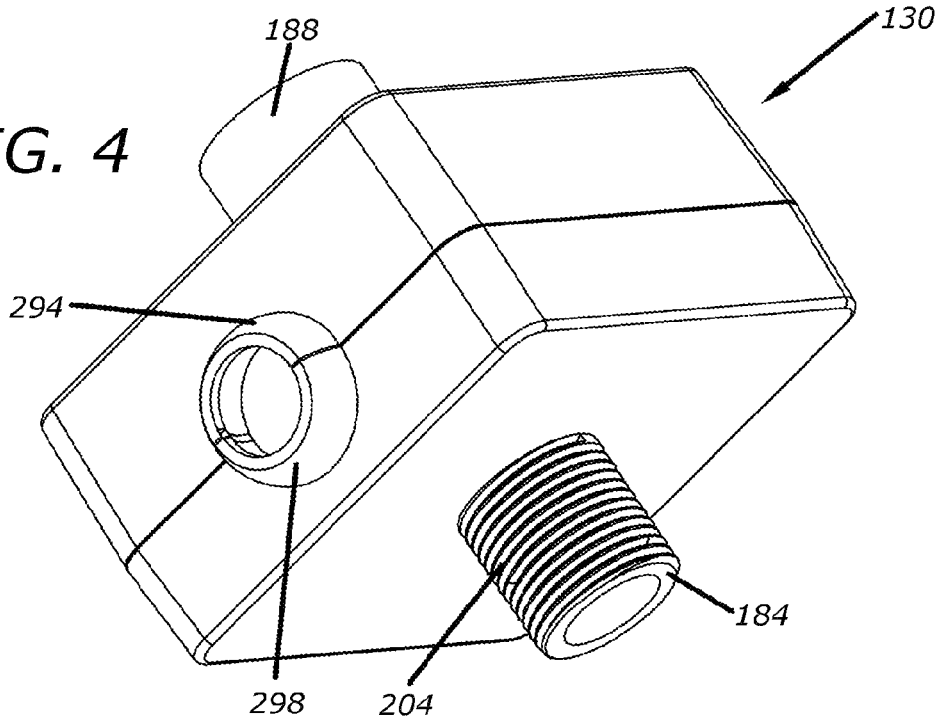
FIG. 4 is a top perspective view of the power unit of the apparatus.
Figure 5:
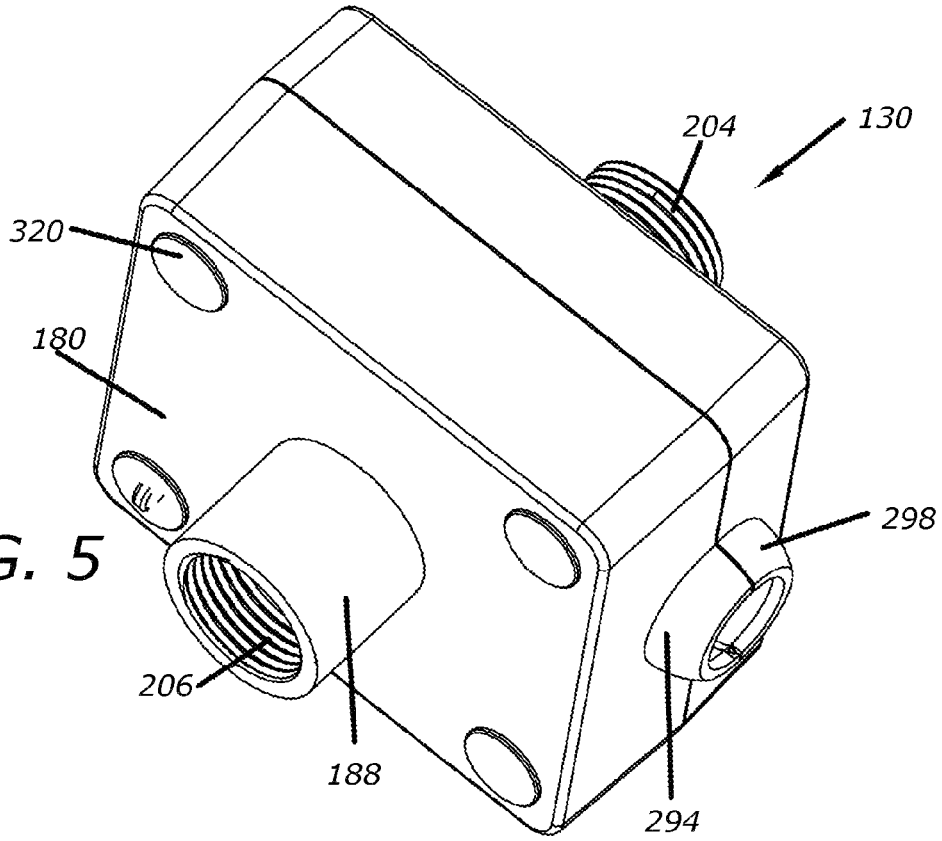
FIG. 5 is a bottom perspective view of the power unit.

Corresponding reference numerals indicate corresponding parts throughout the several views of the drawings.

Referring to FIG. 1, an apparatus of the present disclosure for monitoring and displaying shower water flow is illustrated generally at 100. The apparatus is depicted in an operative position between a water pipe 110 and a shower head 120. Generally, any standard shower head can be used including a handheld nozzle with a long flexible hose. The apparatus 100 can include a power unit 130 and a display unit 140, connected together, for example, by a ball-and-socket joint 150.

Figure 39:
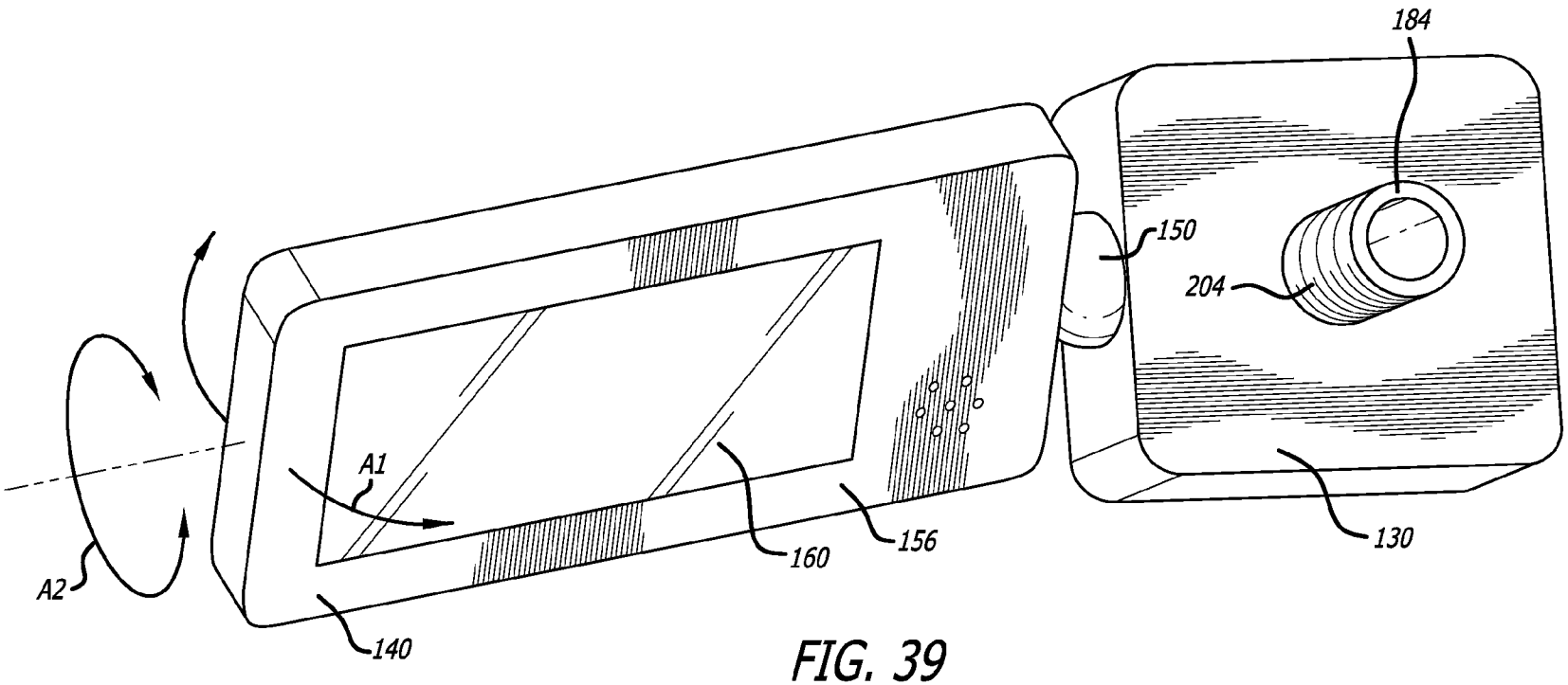
FIG. 39 is a perspective view of the apparatus of FIG. 1, showing the display unit in an adjusted (articulated) position with respect to the power unit and the arrows showing how the position of the display unit relative to the power unit can be adjusted in rotational and pivotal directions.

The ball-and-socket joint 150 allows a user to reposition the front face 156 with its LCD panel 160 and (waterproof) speaker 164 as desired relative to the power unit 130, as can be understood by the arrows A1, A2 in FIG. 39. The user may want to reposition it because of his height, where he likes to stand (or sit) in the water spray W or where he likes to stand (or sit) in the shower stall relative to the front face 156. The front face 156 conveys shower water information to him via the LCD panel 160 and the speaker 164, as is described in detail in this disclosure.

The power unit 130 can also be referred to as a first unit, a recharging unit, a first portion, a water flow path unit, a water temperature unit, a power portion or the like. It can include a housing 180 having a front nipple 184, a rear nipple 188, and a shower water flow path 200 from the rear nipple to the front nipple. The front nipple 184 can have external threads 204 for screwing into a shower head 120. The rear nipple 188 can have internal threads 206 for screwing onto a water pipe 110.

A hydroelectric power generator 210 can be provided in the housing 180 to generate electricity from the water flowing in the water flow path 200. And a temperature sensor 220 (such as a thermistor (FIGS. 10, 11, 21 and 29)) can also be provided in the housing 180 proximate to (in) the water flow path 200 to measure the temperature of the water. The generator 210 can have a generally round shape and can be generally two inches in diameter and generally 1.5 inches thick.

The operation/construction of the hydroelectric power generator 210 will now be described. A hydraulic turbine converts the energy of the flowing water in the water flow path into mechanical energy, and a hydroelectric generator converts this mechanical energy into electricity. The operation of the generator can based on the Faraday principles that when a magnet is moved past a conductor, it causes electricity to flow. In a large generator, electromagnets are made by circulating direct current through loops of wire wound around stacks of magnetic steel laminations. These field poles are mounted on the perimeter of the rotor. The rotor, which is attached to the turbine shaft, rotates at a fixed speed. When the rotor turns, it causes the field poles (the electromagnets) to move past the conductors mounted in the stator. This, in turn, causes electricity to flow and a voltage to develop at the output terminals of the generator.

The display unit 140 can also be referred to herein as a second unit, a second portion, a display assembly unit or the like. The display unit 140 can include a visual and/or audio display assembly 230, which can include the LCD panel 160 and the speaker 164, a printed circuit board assembly 240, and a rechargeable battery 250, which can be a rechargeable 3.7 Volt lithium ion battery.

The printed circuit board assembly 240 can have, for example, a capacitor, a circuit test button, a plurality of LEDs, a resister, an IR receive sensor, a DC-to-DC regulator, at least one battery charging control chip and a PIN slot connector.

The hydroelectric power generator 210 can generate three-phase AC by water flowing in the water path and the display unit 140 can include circuits that rectify, filter and stabilize the AC to 5V DC.

Figure 21:
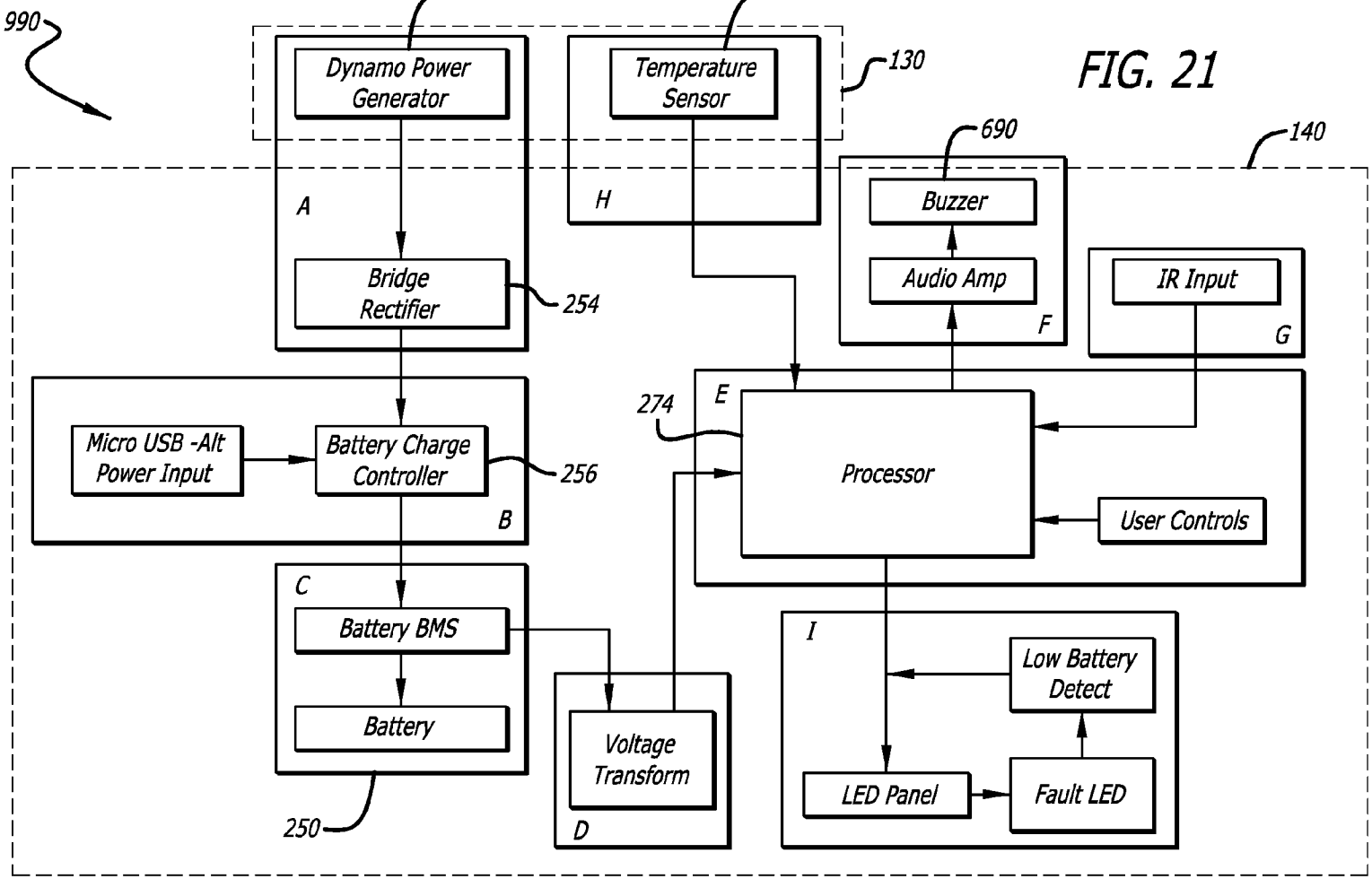
FIG. 21 is a block diagram of a circuit of the apparatus.

The display unit 140 can include the battery 250, a battery charge control circuit and a bridge rectifier 254 (e.g., FIG. 31A) between the power unit and the battery charge control circuit 256 (see FIG. 21). And the display assembly 230 can include an audio circuit and an LED display circuit. FIG. 21 shows the power unit 130 in the upper dotted line box and the display unit 140 in the lower dotted line box.

The printed circuit board assembly 240 can control the operation of the display assembly 230. And the battery 250 can power the display assembly 230. Wires 270 can pass through the ball-and-socket joint 150 and deliver AC to the printed circuit board assembly 240, which converts it to DC, which is sent to the battery 250 to recharge it. Wires 270 from the temperature sensor 220 can similarly pass through the ball-and-socket joint 150 to the printed circuit board assembly (PCBA) 240 to communicate water temperature information, such as by voltage changes, to the assembly for controlling the shower session of the display assembly 230. The temperature sensor 220 and the wires 270 can be seen in FIGS. 10 and 11, for example.

The three wires 270 shown for the thermistor 220 can be power, ground and data wires. The thermistor 220 can have different resistance values in different water temperatures. The resistance values can be transferred to the MCU (micro-controller unit) 274 (on/of the PCBA), and the MCU will have different actions according to the different resistance values.

The display assembly 230 (and the remote control) can be powered by the battery 250, which is recharged by the hydroelectric power generator 210 in the power unit 130 and powered by water flowing in the flow path. Wires 270 (FIG. 10, for example) from the power generator 210 can transmit the AC current to the display unit 140 where it is converted by the controller to DC current, which recharges the battery 250. When the controller detects incoming electricity from the power generator 210 it knows that the water to the power unit 130 has been turned on and that it can start the shower session. Similarly, when the controller then detects no incoming electricity it knows that the water has been turned off and thus it can end the shower session.

Figure 6:
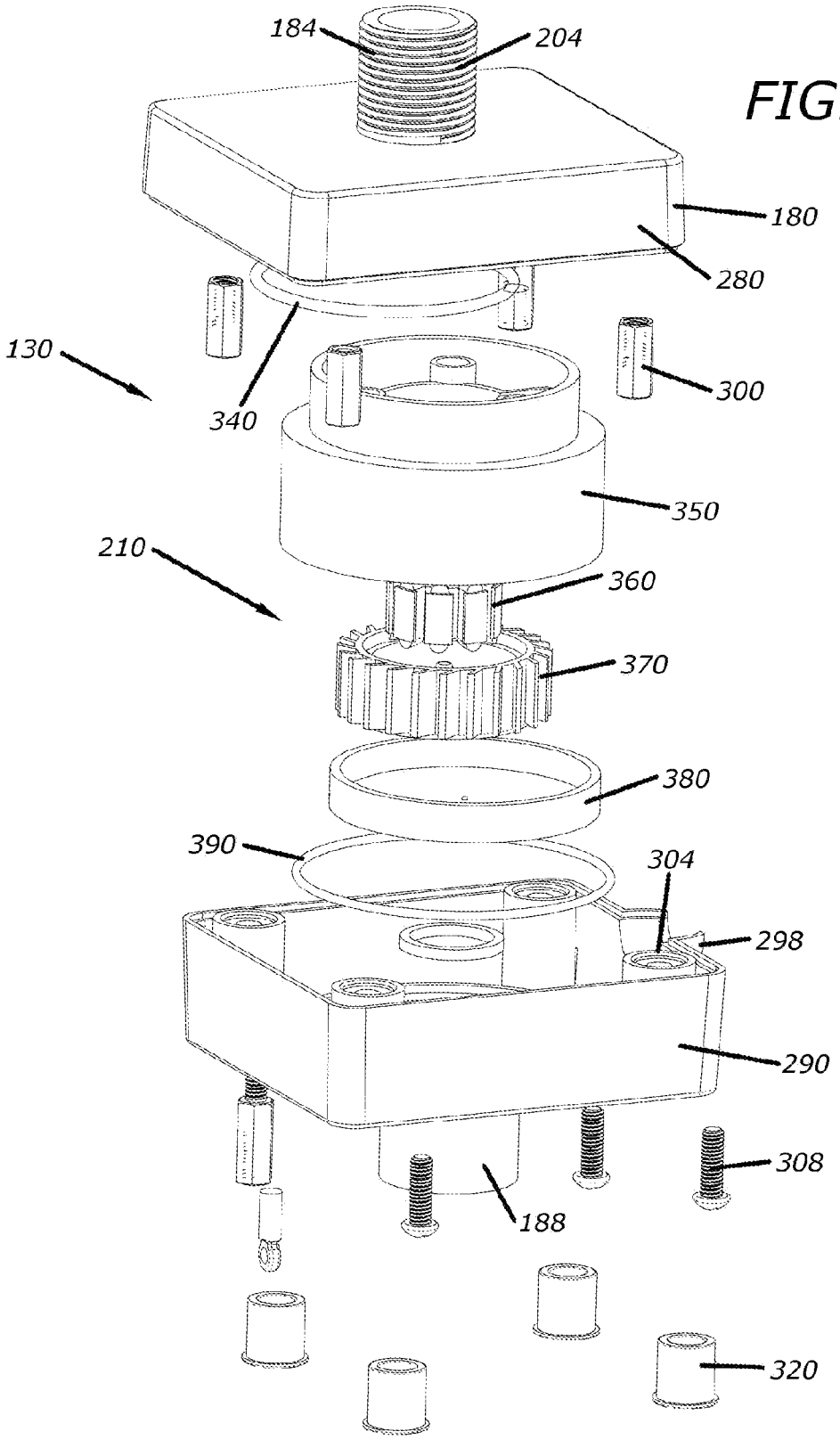
FIG. 6 is a side view of the power unit showing the components in exploded relation.
Figure 7:
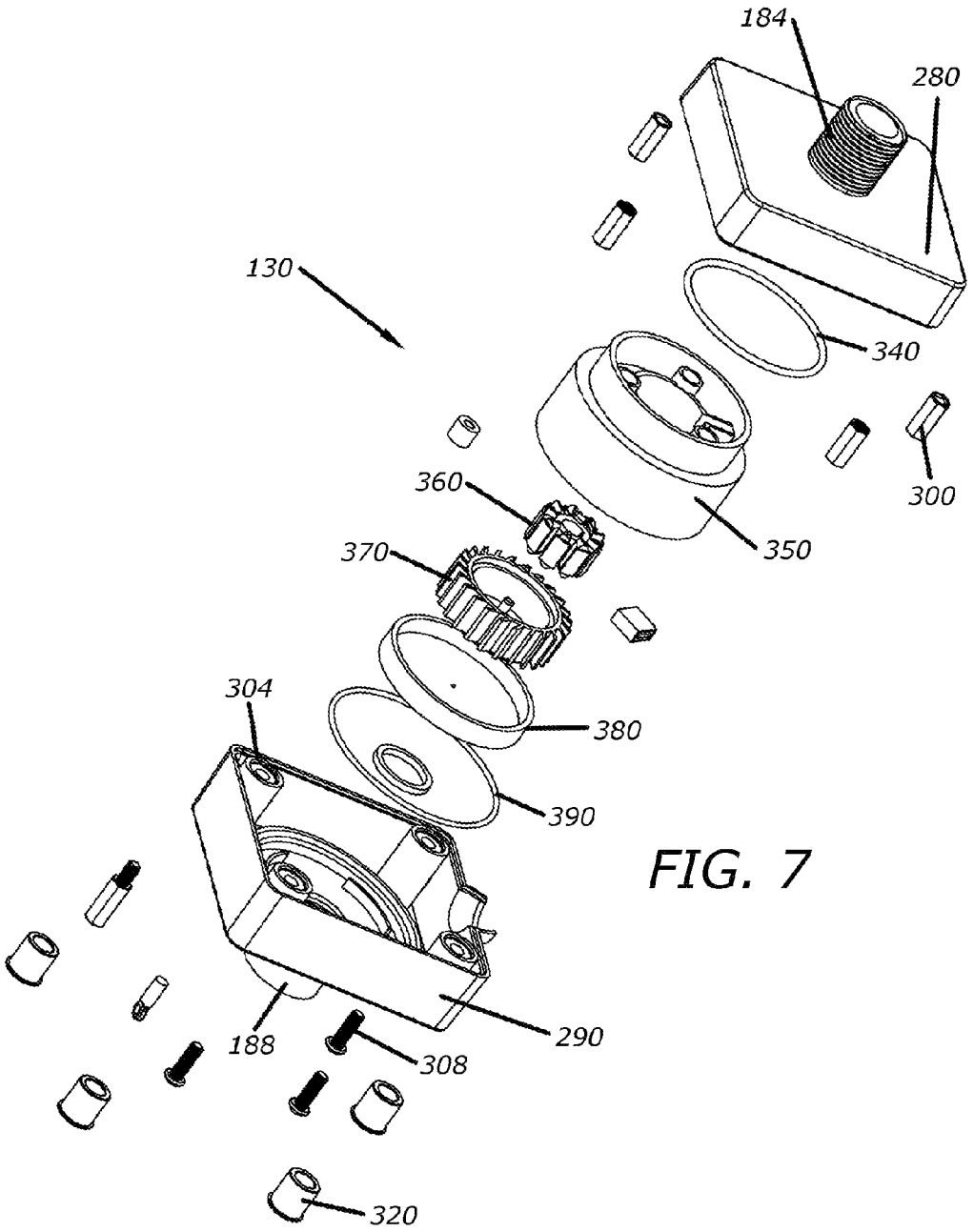
FIG. 7 is another perspective view similar to FIG. 6 but from a top angle.
Figure 8:
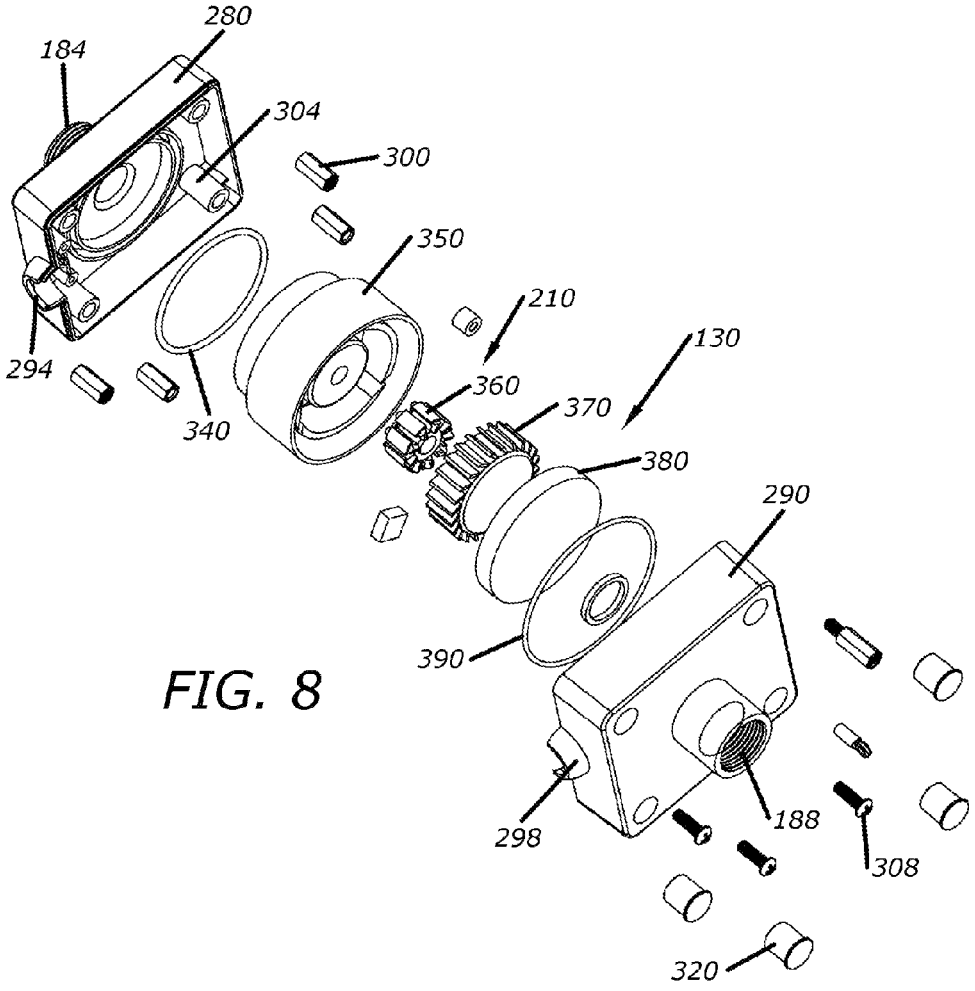
FIG. 8 is a perspective view similar to FIG. 7 but from a bottom angle.
Figure 9:
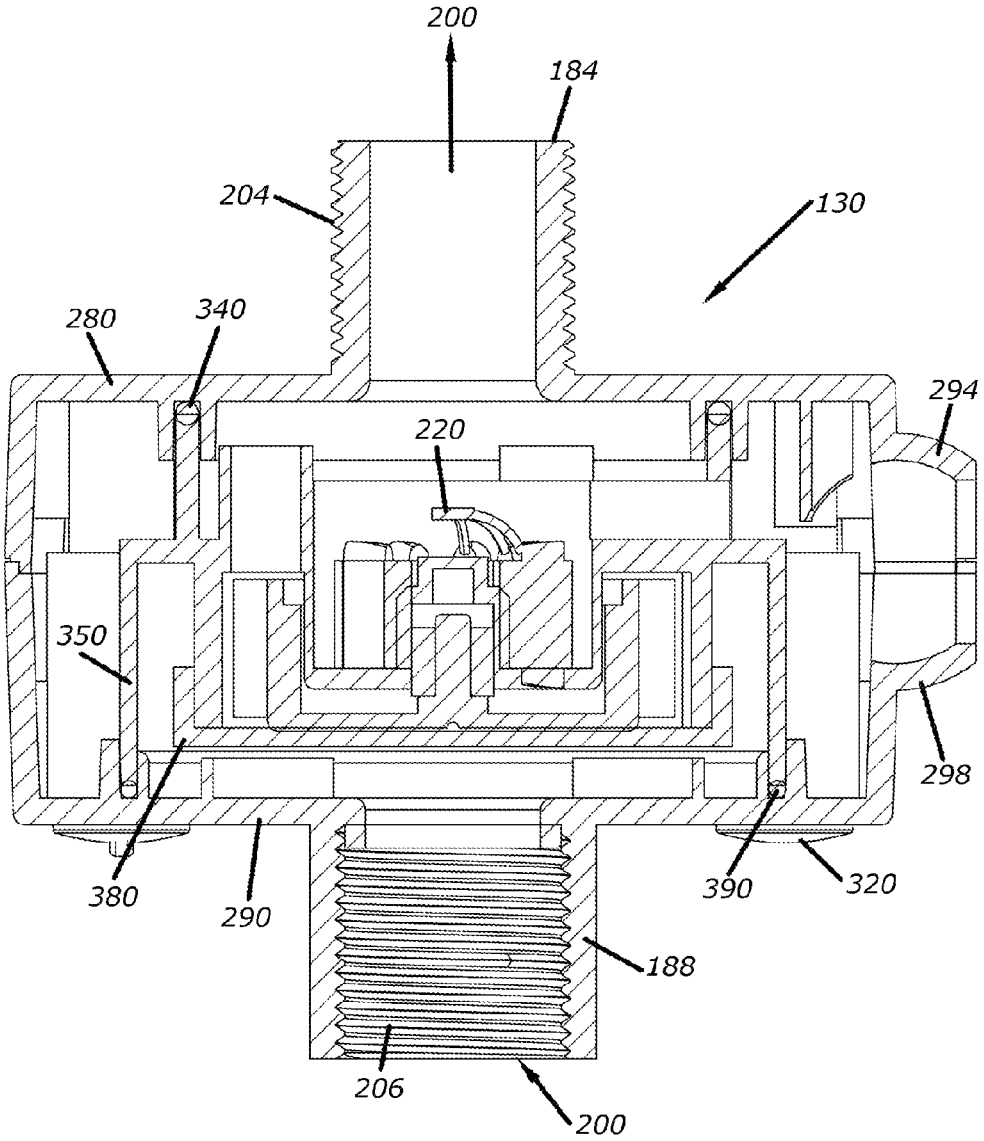
FIG. 9 is a side cross-sectional view of the power unit.
Figure 10:
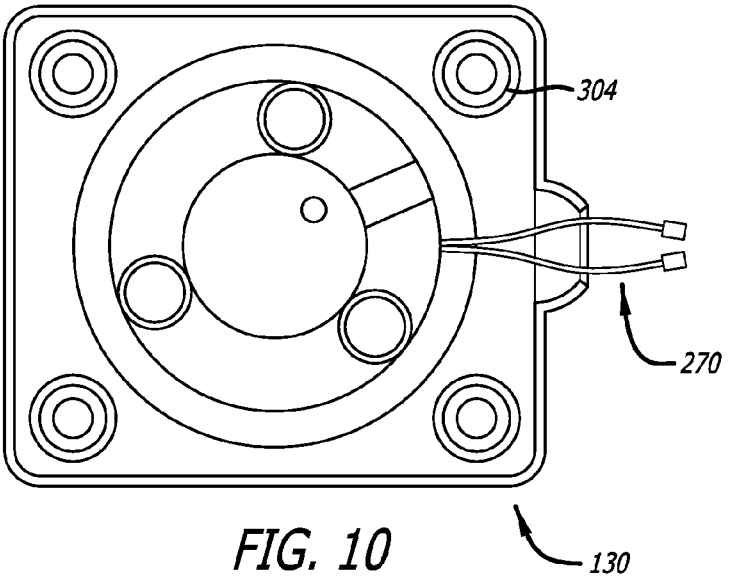
FIG. 10 is a perspective view of the power unit in a partially disassembled condition and showing the connecting wires.
Figure 11:
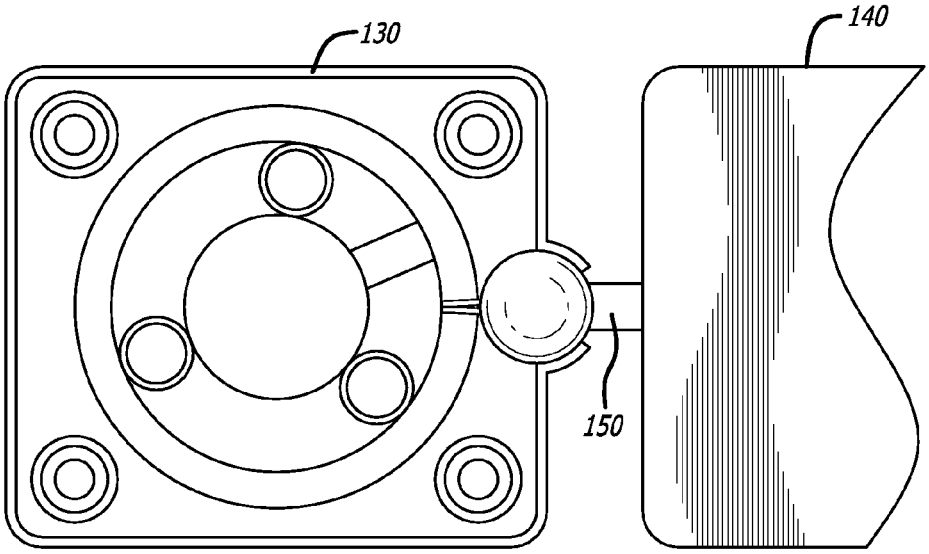
FIG. 11 is a view similar to that of FIG. 10 but showing the wires passing through the ball joint and into the display unit.
Figure 12:
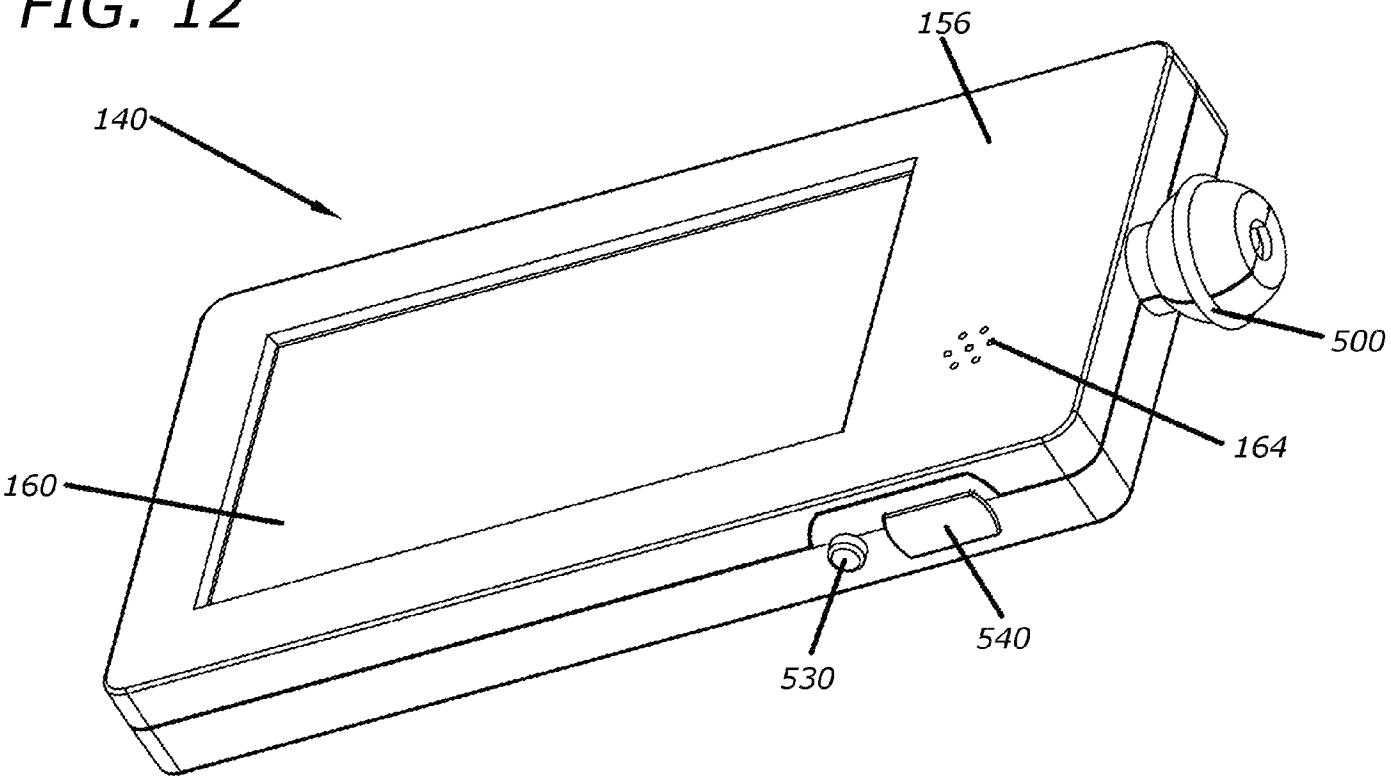
FIG. 12 is a top perspective view of the display unit in isolation.
Figure 13:
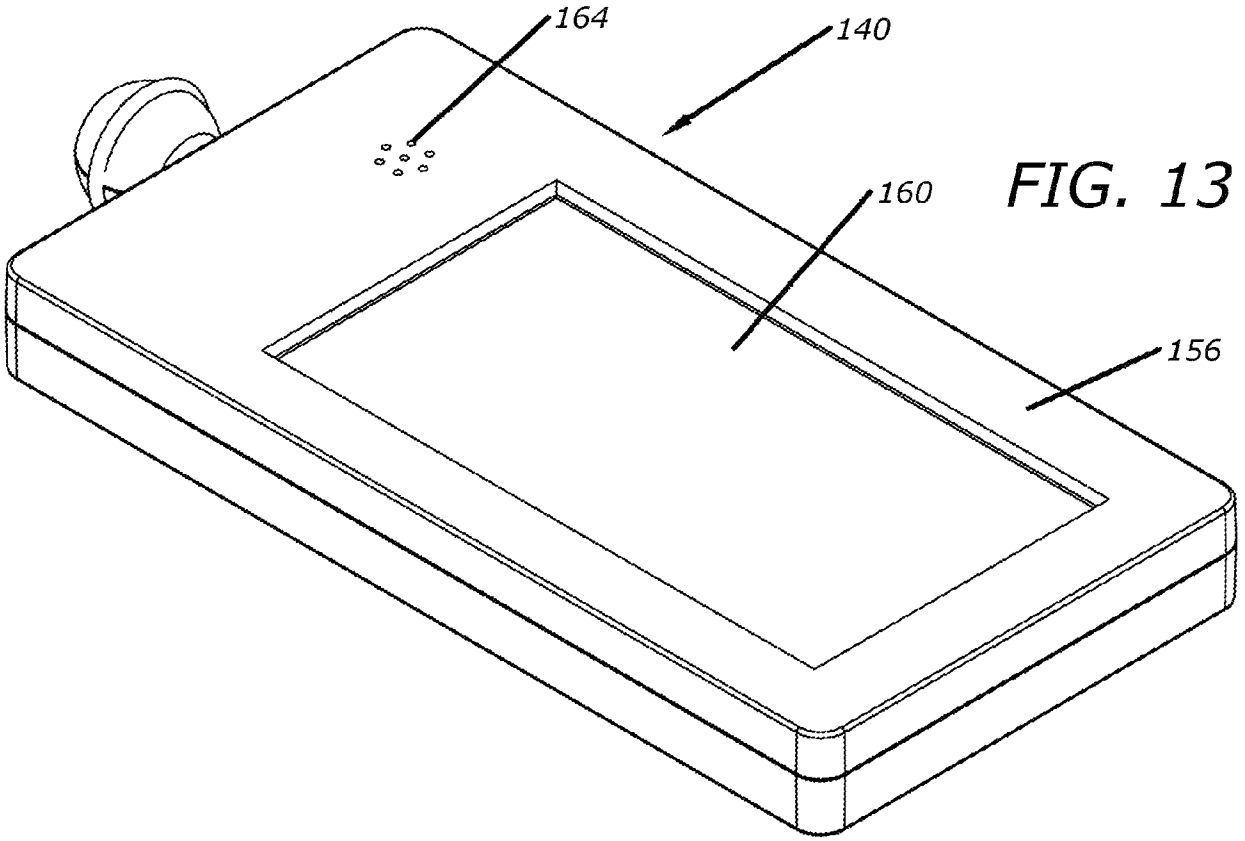
FIG. 13 is a view similar to FIG. 12 but from another angle.

Details of the components and the construction of the power unit 130 are shown in the exploded perspective views of FIGS. 6, 7 and 8 and the cross-sectional view of FIG. 9. Referring thereto the two halves of the housing are illustrated, namely the top cover 280 with the nipple and the bottom cover 290 with nipple. Each housing cover 280, 290 can have a respective half of the socket portion 294, 298 of the ball-and-socket joint, as can be seen in FIG. 8; and FIG. 9 shows them mated with the covers assembled.

The covers 280, 290 can be mated and held together with nuts 300, receptacles 304 in the covers and screws 308. Rubber plugs 320 can cover the screw ends, preventing water intrusion, but still allowing the power unit to be disassembled. The hydroelectric power generator 210 can include, as an example, a first o-ring 340, a power inner housing 350, a dynamo 360, an impeller 370, a power inner cover 380 and a second o-ring 390, as shown in FIG. 6.

Figure 15:
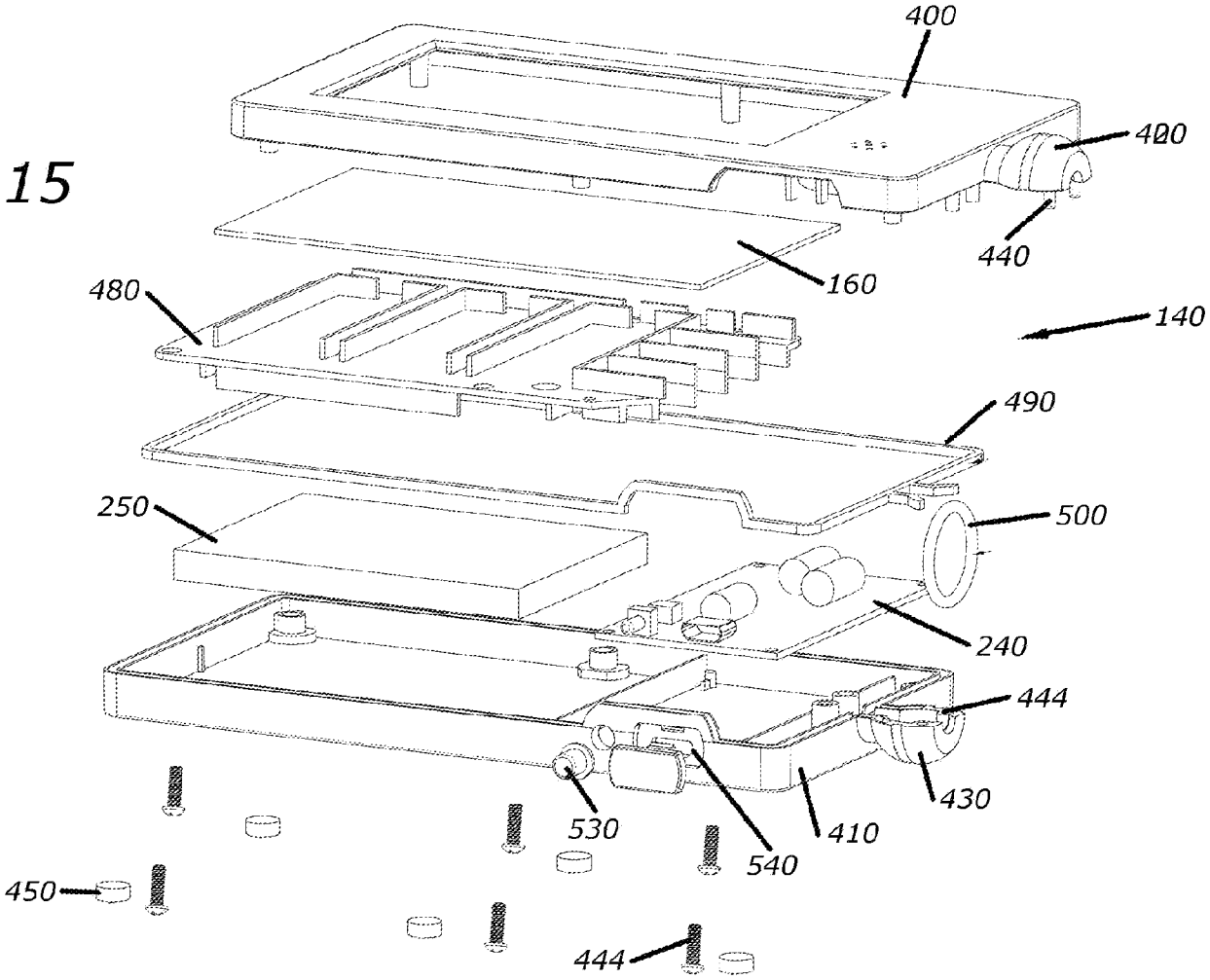
FIG. 15 is a side perspective view of the display unit showing the components in exploded relation.
Figure 16:
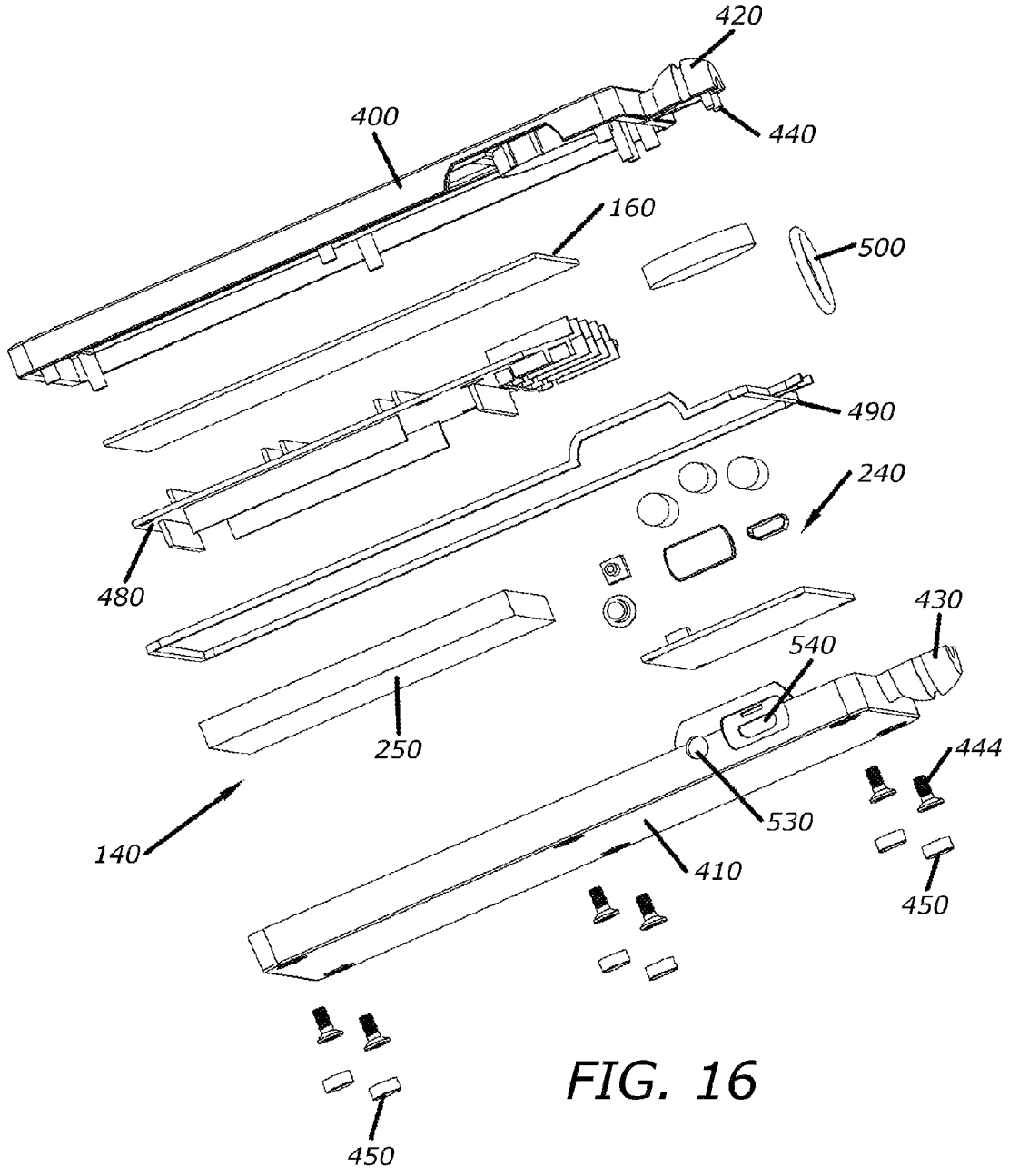
FIG. 16 is a view similar to FIG. 15 but from a bottom angle.
Figure 17:
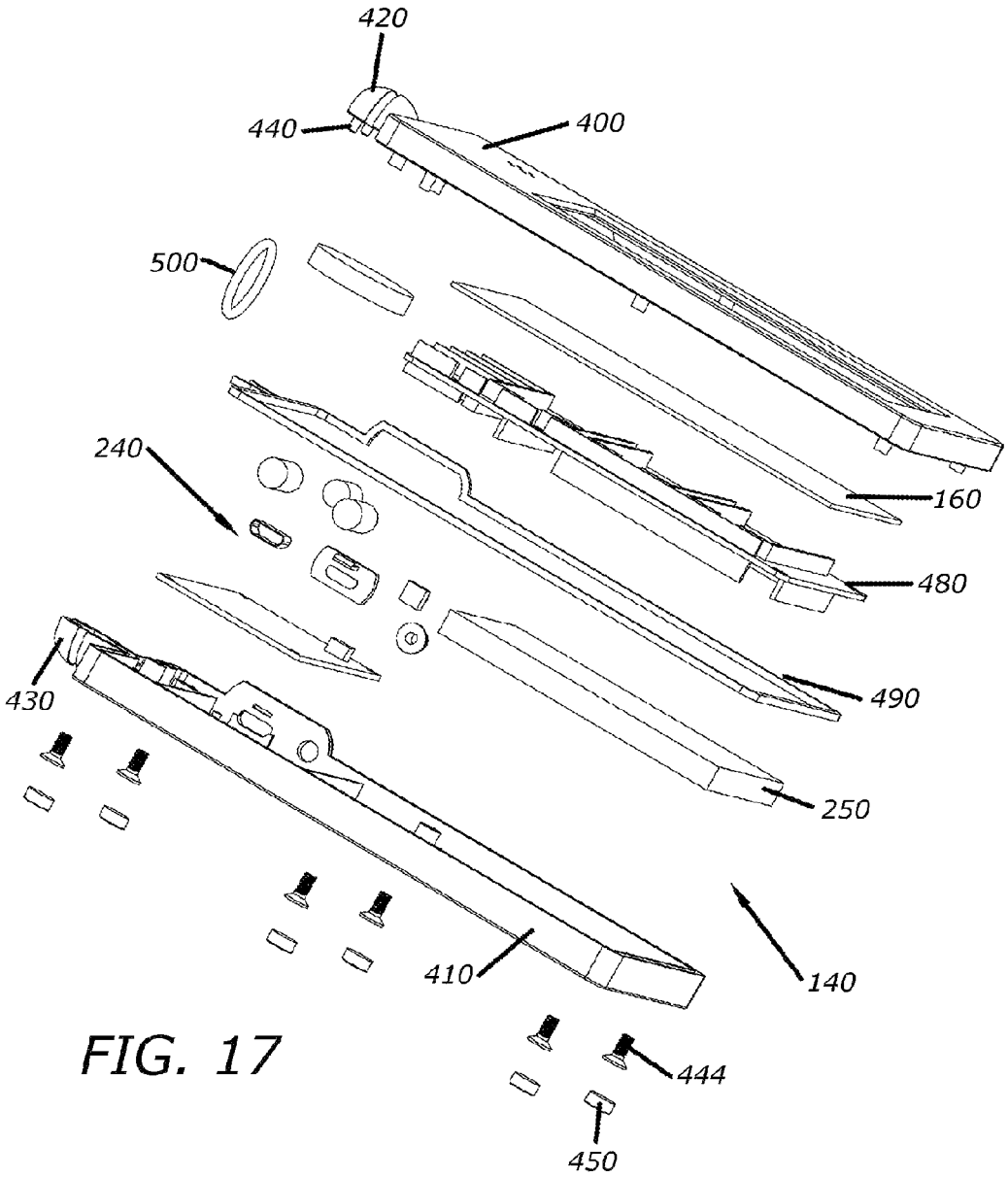
FIG. 17 is a view similar to FIG. 16 but from a top angle.
Figure 18:
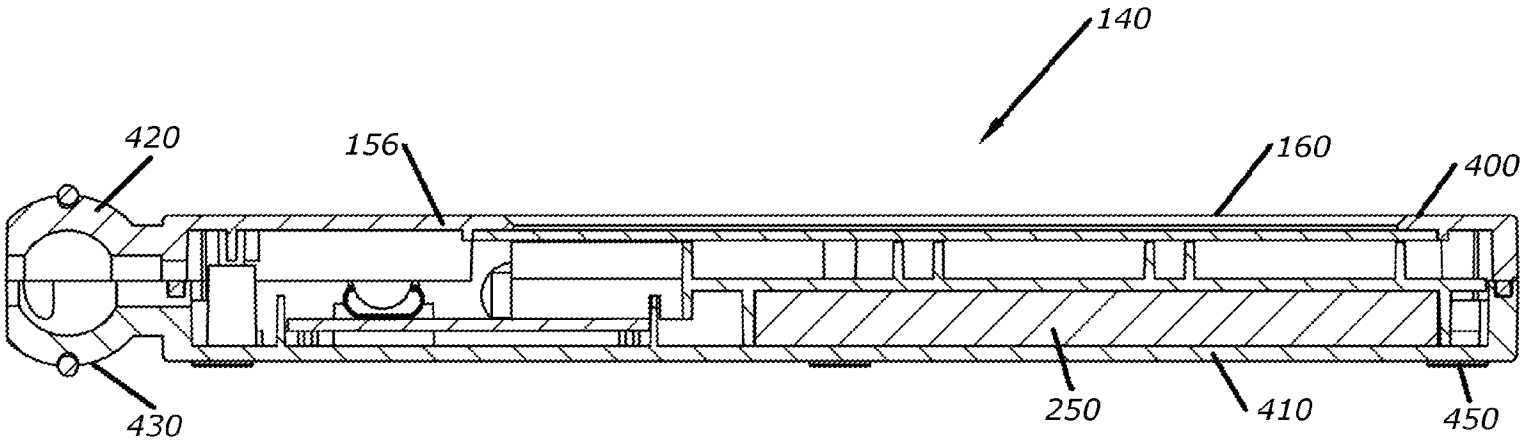
FIG. 18 is a cross-sectional view of the display unit.

Similarly, details of the components and construction of the display unit 140 are shown in the exploded perspective view of FIGS. 15, 16 and 17 and the cross-sectional view of FIG. 18. The housing can include a display top cover 400 and a display bottom cover 410, both of which include opposing halves of the ball 420, 430 of the ball-and-socket joint. When the top and bottom covers 400, 410 are assembled together the ball halves mate and the pegs 440 of the upper ball half fit into the openings 444 in the lower ball half.

Referring to FIGS. 15-18, the display covers 400, 410 can be mated and held together using receptacles in the covers and screws 444. Rubber plugs 450 can cover the screw ends, preventing water intrusion, but still allowing the power unit to be disassembled. Inside the housing can be the LCD display 460, the display inside housing 480, the display seal 490, the display o-ring 500, the printed circuit board assembly 240, and the battery 250. On the side of the display bottom cover (or the bottom edge) can be a display button (mute button) 530 and a USB port 540 having a cover.

Figure 14:
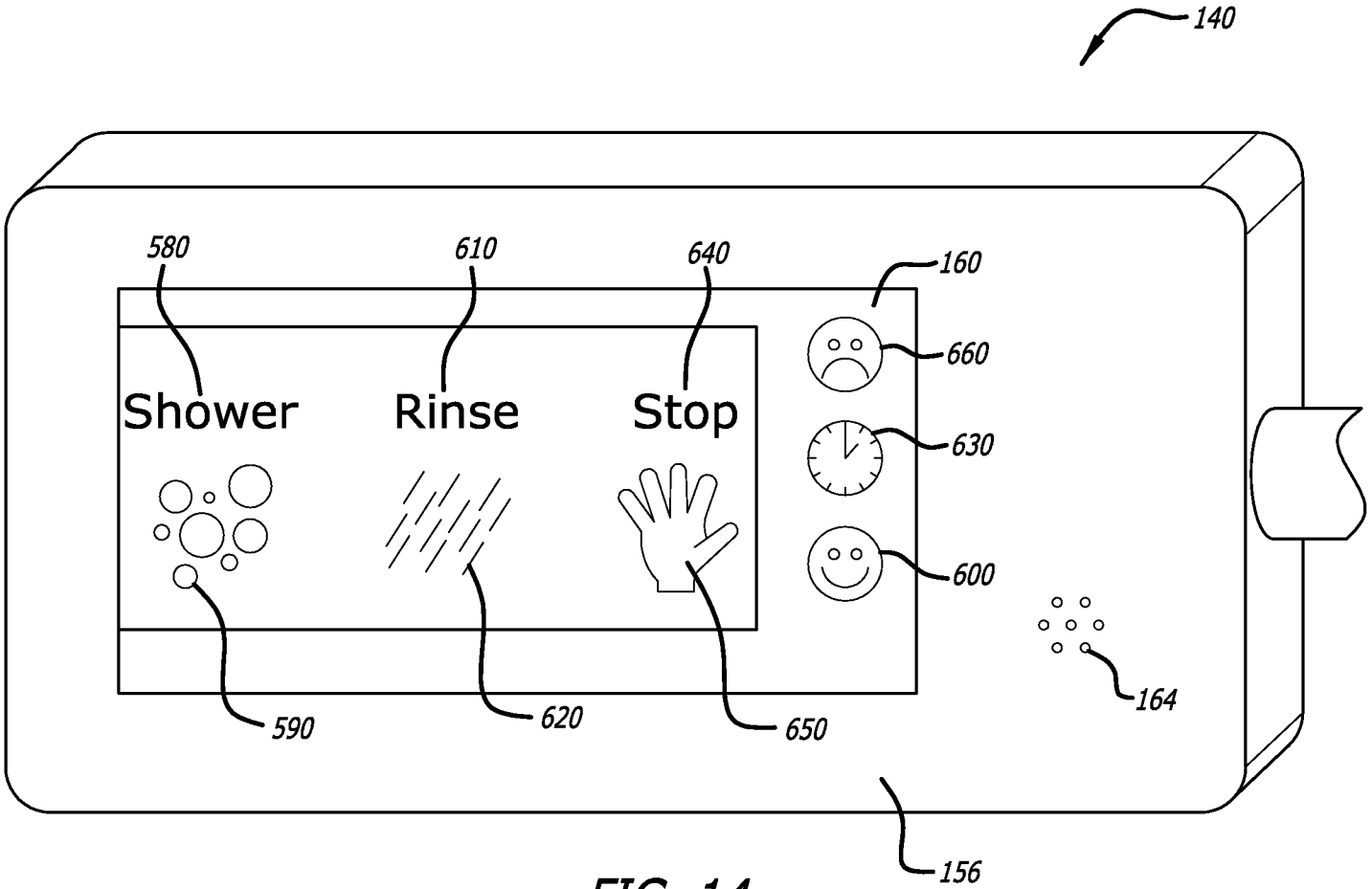
FIG. 14 is a front perspective view of the display unit and showing the icons of the display screen thereof.

The display assembly 230 can include (for the LCD) three (or two) green LED lights 550, three (or two) yellow LED lights 560 and three (or two) red LED lights 570, and their operation can be controlled by the micro-controller 275 of the printed circuit board assembly 240. Referring for example to FIG. 14, one or two green lights can illuminate the word "Shower" 580 and a "bubbles" symbol 590, and one green light can illuminate a Smiley face 600 in the color bar. One or two yellow lights can illuminate the word "Rinse" 610 and a "water drop" symbol 620, and one yellow light can illuminate a Clock or stop watch symbol 630 in the color bar. One or two red lights can illuminate the "Stop" 640 and hand symbol 650, and one red light can illuminate a Sad Face symbol 660 in the color bar. (The LEDs are illustrated, for example in FIGS. 26, 30, 31, and 34.) FIG. 14 also illustrates the speaker opening for the audio sounds/signals.

Figure 19:
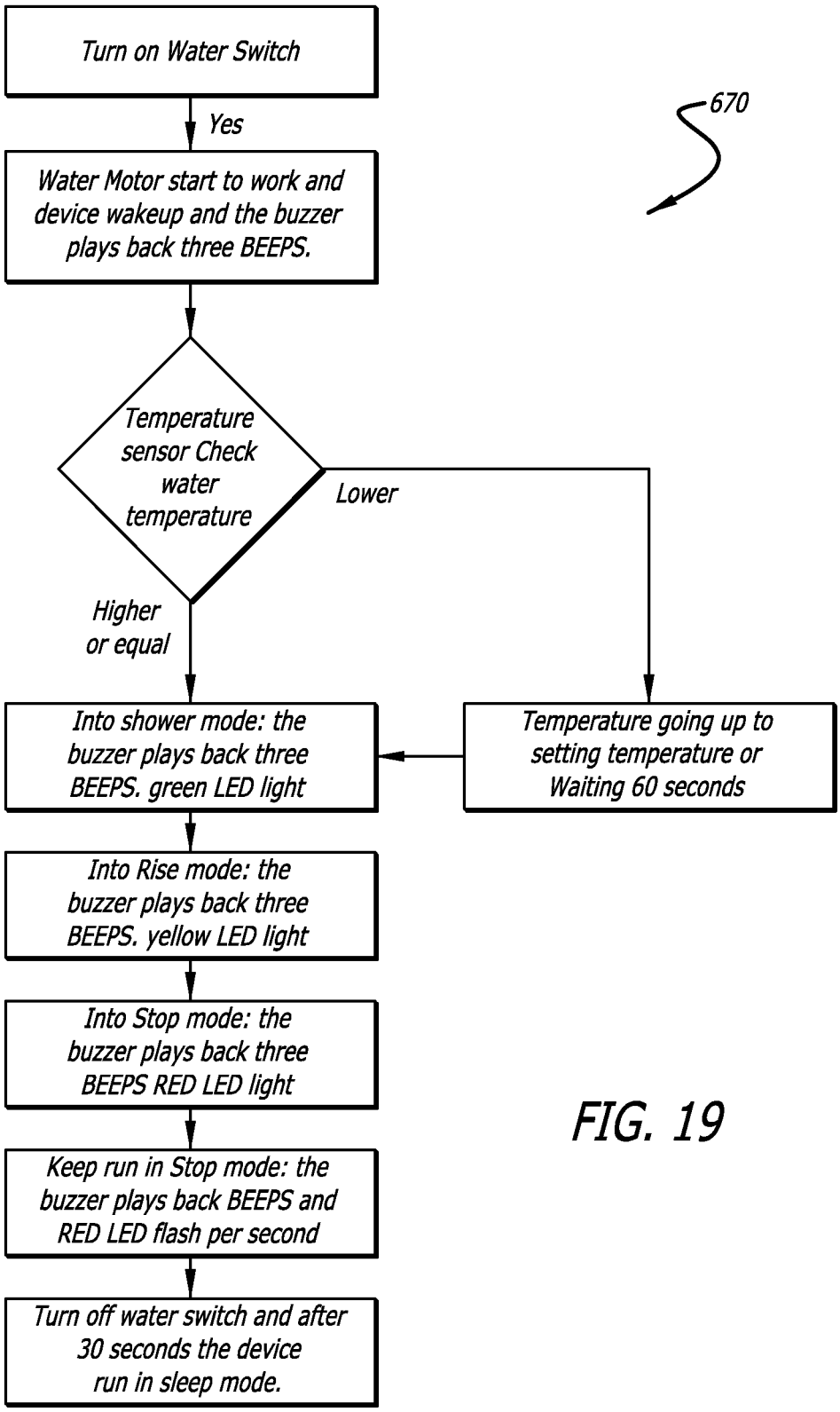
FIG. 19 is a flow chart showing an operation of the display assembly of the apparatus.
Figure 20:
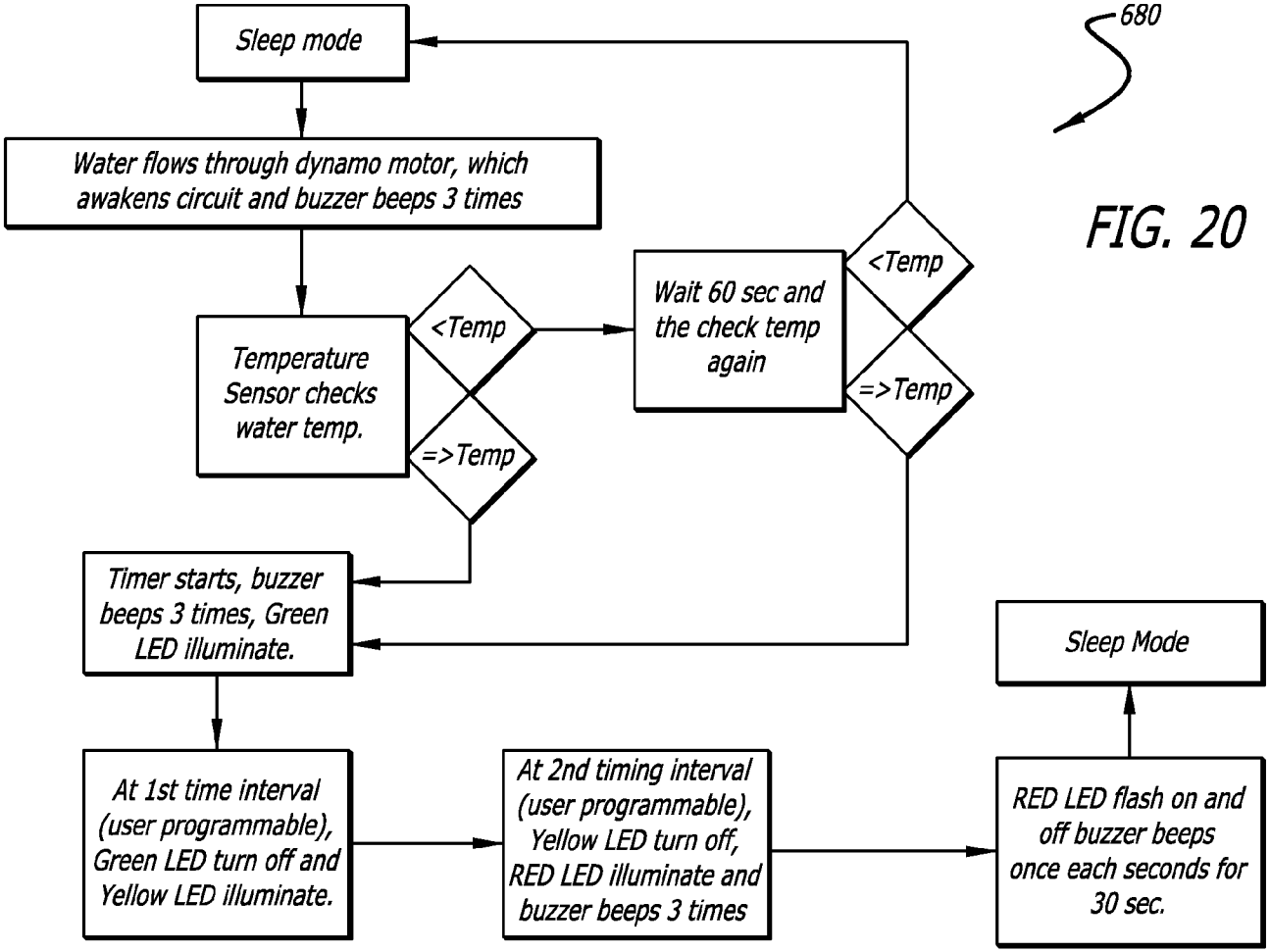
FIG. 20 is a flow chart showing an operation logic of the apparatus.

The operation of the display assembly 230 for an exemplary shower session of the present disclosure can be understood with reference to the flow charts 670 and 680 of FIGS. 19 and 20. A user turns the water on and water flows through the hydroelectric power generator 210, causing electricity to be generated and transmitted to the printed circuit board assembly 240, which awakens the circuit. The buzzer 690 plays back three beeps. (The buzzer (FIGS. 21 and 27) in addition to emitting a buzzing sound, can be a speaker capable of emitting a variety of sounds including voice messages, as discussed herein.) The temperature sensor 220 is sensing the temperature of water flowing in the water flow path and sending corresponding signals to the PCBA 240. The signals can be corresponding voltages and the sensor 220 can be a thermistor, as mentioned previously. The PCBA 240 can continually check the temperature or check it periodically, such as every sixty seconds. (See flow charts 670 and 680.)

The thermistor 220 has different resistance values in different water temperatures, and the display unit 140 can include a microcontroller and the display assembly 230. The different resistance values when actuated cause the microcontroller/MCU 274 to instruct the display assembly 230 to take different actions.

When the PCBA 240 receives a signal (from the thermistor 220 and via a wire) indicating that the shower water has reached a predetermined temperature, the timer in the PCBA starts the shower session. It can start it by causing the buzzer 690 to beep three times and the green LEDs to be illuminated. After the passage of a first time interval, representing the "shower" stage, the green LED lights are turned off and the yellow LED lights are illuminated. The first time interval can be programmable by the user/customer as discussed herein.

Turning the yellow LED lights on represents the start of the "rinse" stage of the shower session, which lasts for a second time interval. The second time interval can be programmable by the user as discussed herein.

After the passage of the second time interval, the first phase of the "stop" stage begins with the illumination of the red LED lights and the buzzer beeping three times. The first phase can last for a third time interval, and can also be programmable by the user.

As examples, the shower stage can last between five and seven minutes and the rinse stage can last between forty-five seconds and ninety seconds. And the first phase of the stop stage can last between forty-five seconds and ninety seconds.

After the passage of the third time interval, the second phase of the stop stage starts and it lasts until the water is turned off. During the second phase, the red LED lights can flash on and off and the buzzer can beep once each second. It can be a more urgent audio and/or visual display than that of the first phase, and also a more annoying one, e.g., more frequent, louder and/or shriller. Turning the water off causes the water switch to turn off, and after thirty seconds, for example, the apparatus 100 goes into a sleep mode. The sleep mode can be understood, for example, from the operating logic diagram of FIG. 20.

As an example, the factory settings for the time periods can be six minutes for the shower stage, one minute for the rinse stage and one minute for the first phase of the stop stage, and three minutes to avoid the alert stage.

The grace period (first phase) can be approximately one minute and the audio stop display can be a continuous beeping sound or repeating message. The shower session can include a delay of three (or more) minutes prior to commencement of a second shower session.

In other words, the display unit 140 can play pre-recorded audio messages at specified time intervals like those discussed below.

First sound notation: Chime, Chime! Audible notation when the water temperature reaches pre-determined shower temperature (e.g., ninety degrees), thereby alerting the user that the water is now warm enough to shower, and thus preventing minutes, and gallons of hot water from going down the drain. (This event also starts the lighting sequence on the display unit 140, accompanied by the Green Light, and illumination of the Smiley face 600.) (See FIG. 14.)

Second sound notation: When the allotted showering time (shower stage) has been reached an audible chime is played to remind the user that his shower (soaping) time is up, and to transition to a Rinse cycle, accompanied by a Yellow Light and a Stop Watch image or water drops 620 on the color bar. (See FIG. 14.)

Third sound notation: When the allotted "Rinse" time allocation has been reached, there is a third sound notation accompanied by a red light, and an Open Palm image 650 on the color bar. (See FIG. 14.)

Fourth sound notation: When the allotted time to "stop showering" has been reached, signaling the individual to exit the shower, a Red light, Frowning Face 660 appear on the color bar. (See FIG. 14.)

Fifth sound notation: Should the user fail to turn the water off after being notified to "stop": a continual "chime, chime, chime" sounds as the Open Palm image 650 (FIG. 14) blinks on and off. This blinking and chiming continue until the water is turned off.

The apparatus can also have an "alert" mode, which can be considered as part of the shower session or as an adjunct thereto. The alert mode discourages users from short cutting the shower session by turning the water off before the start of the first phase (or alternatively the second phase) of the Stop Stage and then quickly (before the passage of a relatively short predetermined time period) turning the water back on, and thereby avoiding the (annoying) second phase (or the first and second phases) of the Stop Stage.

As an example of the alert mode if the user turns the water off before the Stop Stage of the shower session and then turns the water back on before a predetermined time period (such as three minutes or between two and fifteen minutes) has passed, the display assembly 230 emits an audio and/or visual alert such as beeping sounds accompanied by blinking lights. Another example can be blinking lights accompanied by a voice message from the speaker/buzzer, such as "please exit the shower," "allotted shower time has been exceeded; please exit" or something similar. In other words, the alert "session" discourages a user from obtaining a long shower time by avoiding the full shower session, that is, by avoiding the annoying audio/visual signals of the stop stage.

In other words, should a person turn the water off, during for example the rinse stage, the timer continues normally, per programming instructions. The apparatus "carries on" with its orders and timing sequence. During Stop Supreme (the alert mode) the idea is to make annoying lights and sounds which last until the user turns the shower water off. Once the water is turned off, there is a program, such as a three-minute program, that runs internally. Should the water be turned back on, during that program, the Stop Supreme alert mode starts all over again, and the three minutes gets re-set back to the top.

Electricity being delivered to the controller from the hydroelectric power generator 210 signals that water is flowing in the water flow path, and electricity not being delivered to the controller signals that water is not flowing in the water flow path.

Figure 31A:
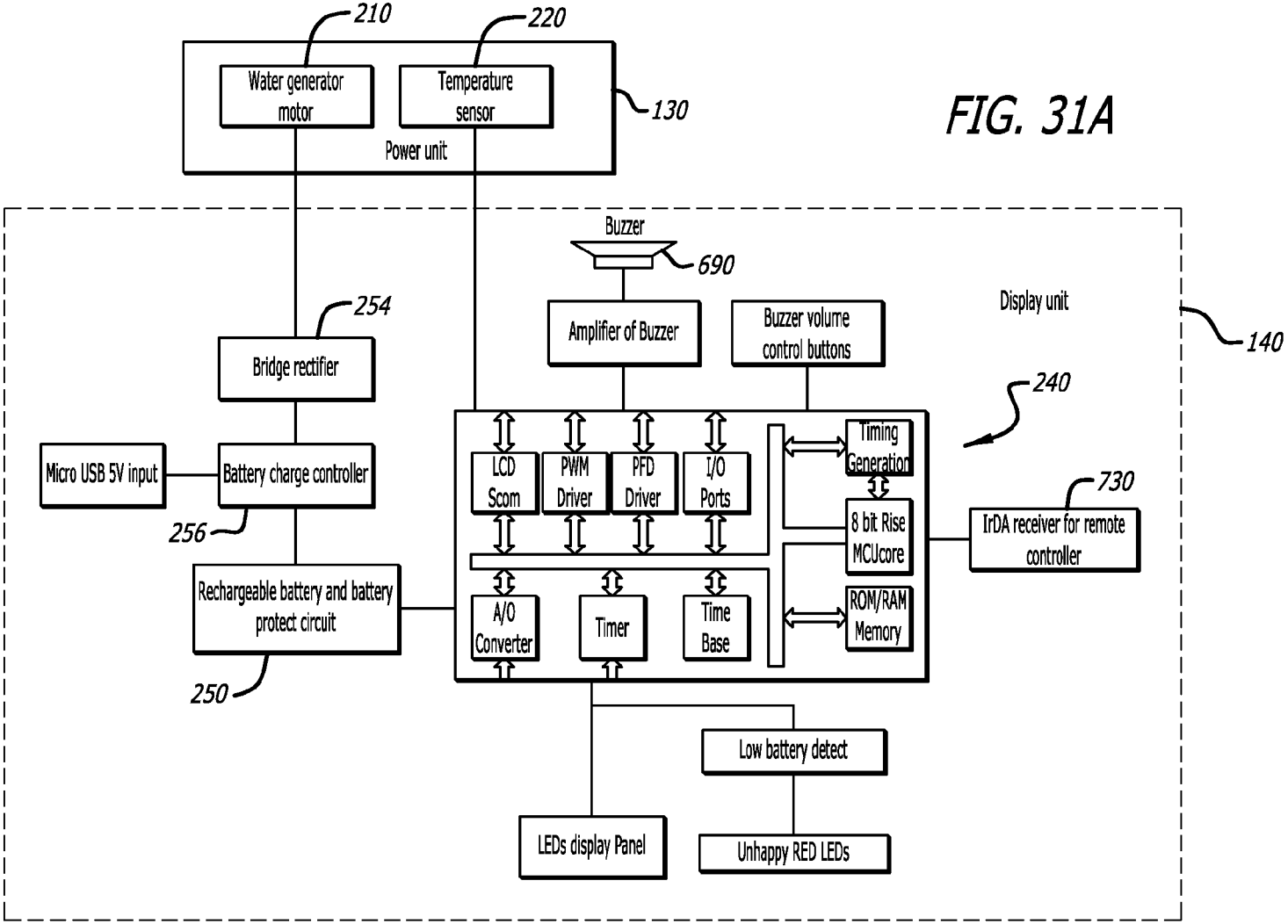
FIG. 31A is a block diagram of the power unit and the display unit of the apparatus.
Figure 31B:
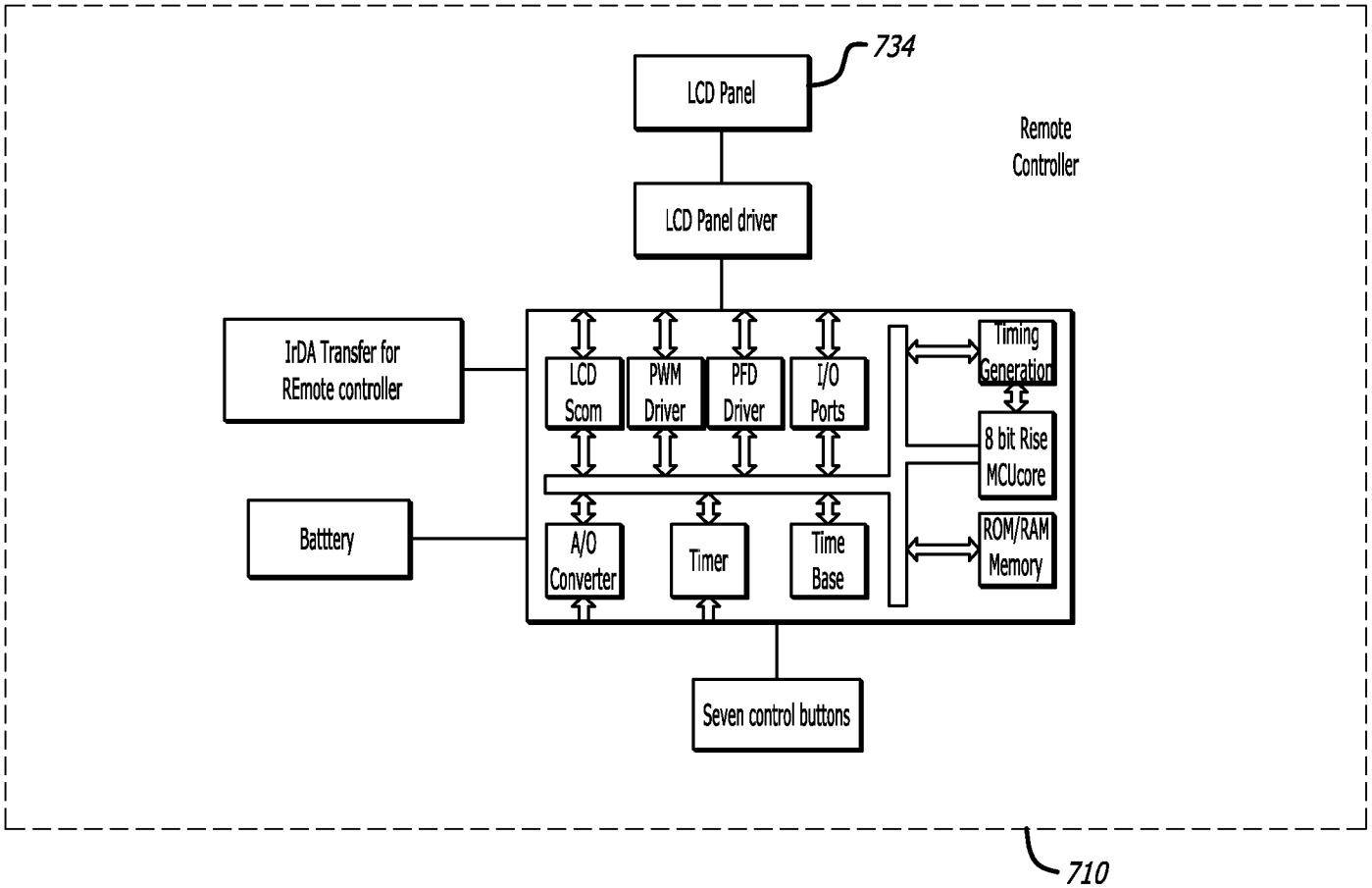
FIG. 31B is a block diagram of a remote control of the present disclosure for positioning in operative position relative to the display unit in the block diagram of FIG. 31B.
Figure 32:
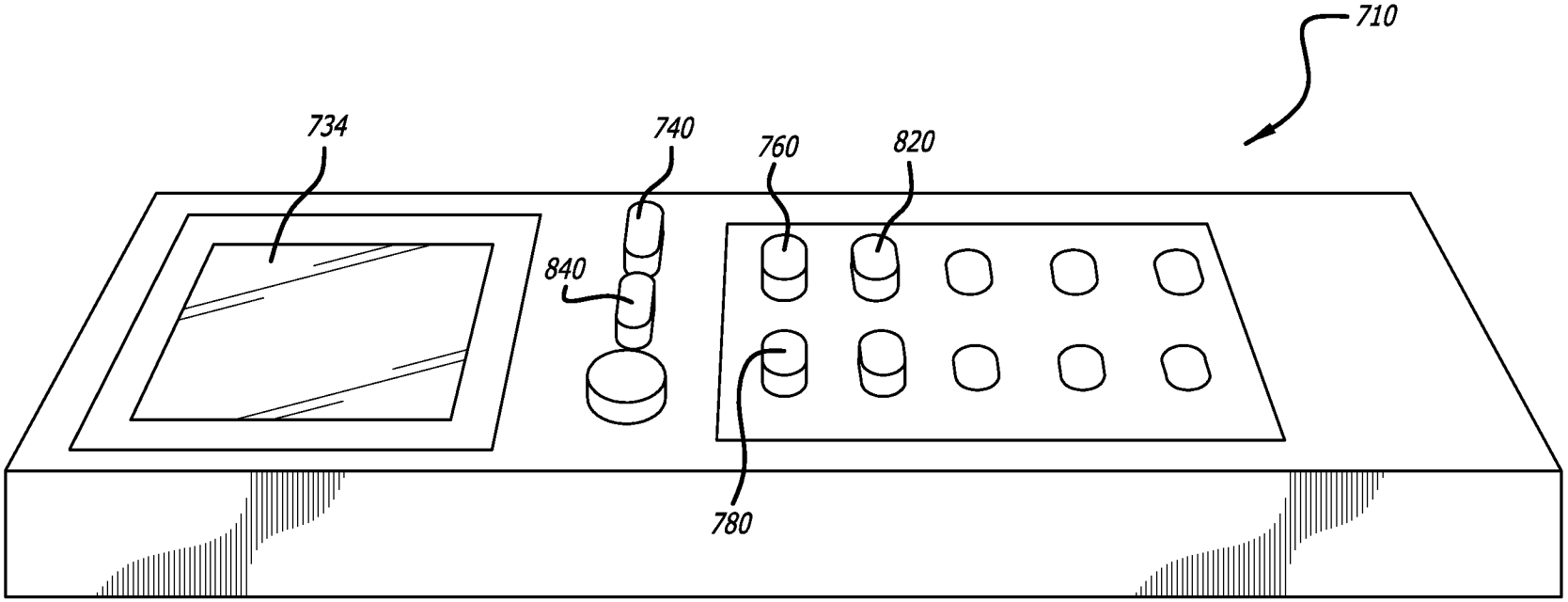
FIG. 32 is a top perspective view of the remote control of FIG. 31B.
Figure 33:
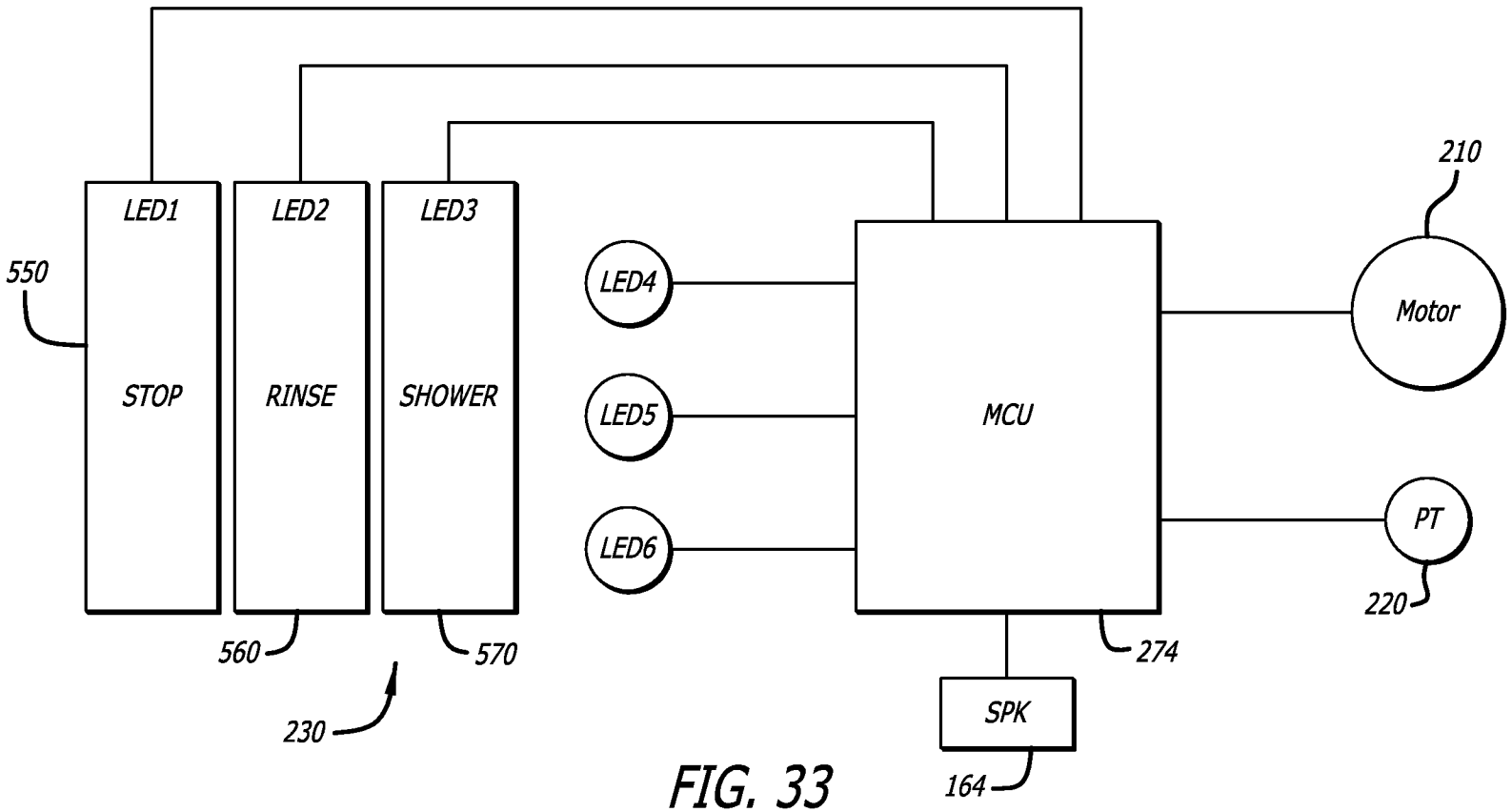
FIG. 33 is a block diagram showing the interconnections of functional elements of the apparatus.
Figure 34:
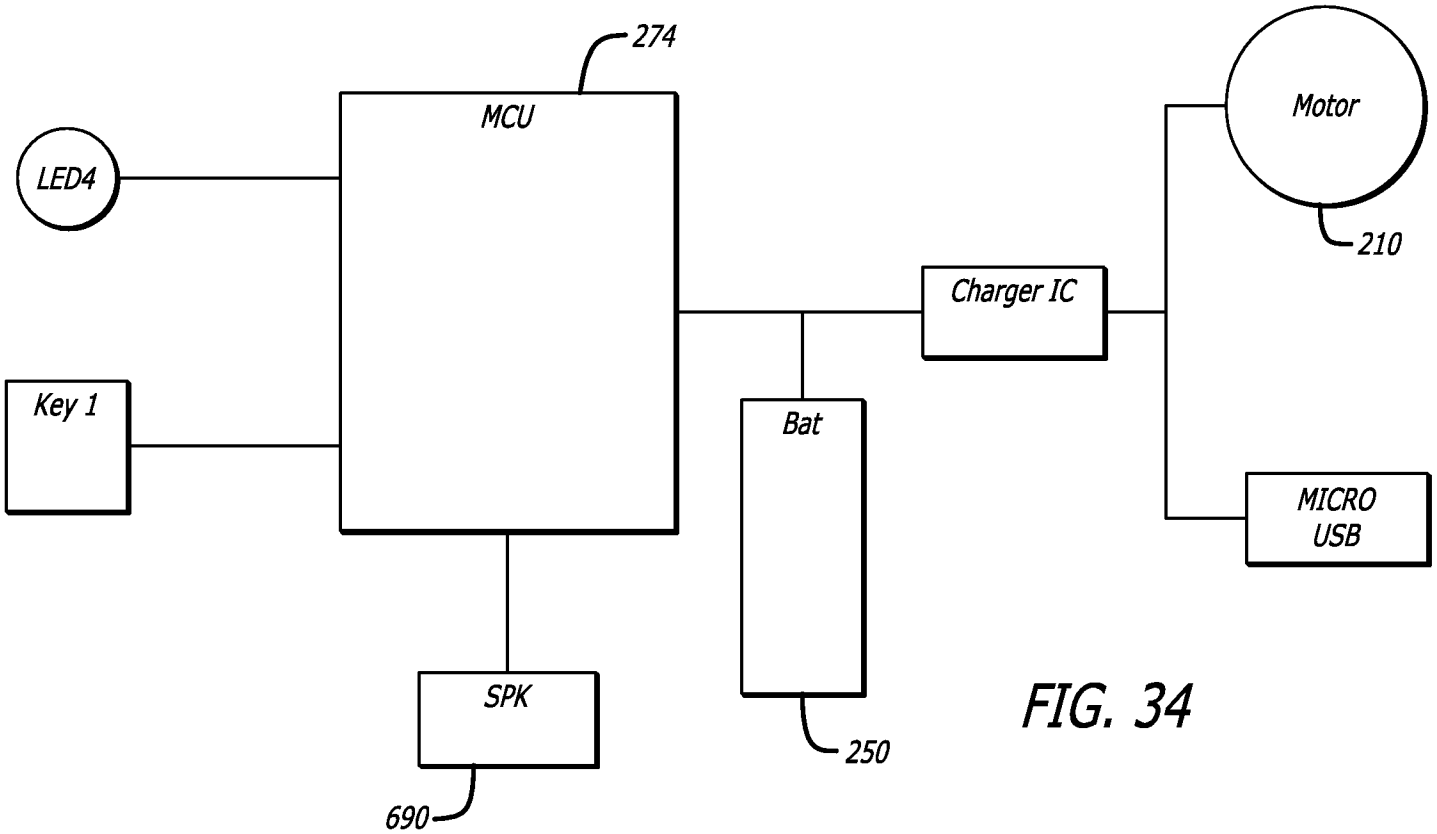
FIG. 34 is a functional schematic block diagram of the apparatus.

The apparatus can be sold or otherwise made available to the user with a predetermined temperature and the shower session fixed, or with the predetermined temperature and/or shower session customizable by the user. One way of customizing is to use a remote control unit (FIGS. 31B and 33) 710 that operatively connects to the controller via an IR sensor 730. Referring for example to FIGS. 31A and 31B, the display unit 140 can include an infrared sensor 730 that is configured to receive signals from the remote control. The remote control 710 can allow a user to re-program the controller or PCBA to change the volume, duration and/or sound of the audio signals, to change the times of at least one of the stages of a shower session of the apparatus and/or to change the water temperature setting of the start of the shower session. And referring again to FIGS. 31A, 31B and 32, the remote control 710 can have an LCD panel 734, a first button 740 for adjusting the volume of an audible display, a second button 760 for adjusting the length of a shower stage of the session, a third button 780 for adjusting the length of a rinse stage of the session, a fourth button 820 for adjusting the length of a stop stage (or a first phase of the stop stage) of the session, and a fifth button 840 for mute.

In other words, the infrared sensor 730 allows for easy re-programming without having to remove the apparatus 100 from the shower pipe 110 (see FIG. 1). The remote control 710 can be used to re-program: the volume (or the buzzer/speaker) to make it louder or softer; the time to make the shower session stages (e.g., shower, rinse) longer or shorter; and the (thermistor) temperature to raise or lower the temperature start setting.

Another way to customize/reprogram the operation of the display assembly 230 can be to plug one end of a cord into the USB port 540 of the display unit and the other end connected to a computer. With the computer accessing a website 850 (see FIG. 35) of this disclosure and synched with the controller, the user chooses by clicking on the appropriate areas on the page on the computer monitor the desired water shower temperature, the lengths of the wash, rinse and stop (first phase) stages, the audio selections for each of the stages, and/of the blinking and/or beeping rates for the alert session or mode.

More particularly, with the computer accessing the website and synched up to the apparatus 100 and its internal controller, the user can re-program the factory settings of the controller. The apparatus 100 can be synched up via the USB port 540 on the display unit 140. Thereby, the user can program the desired starting temperature, the duration of the shower stage, the duration of the rinse stage, and the duration of the stop "grace" period phase. Using the computer/device interface 850, the user can also select and re-program the factory set audio alerts, selecting from a list of sound effects and volumes. These sound effects and/or voice recordings can be used to alert the user that the shower temperature has been reached, the shower time is up, transition to rinse stage, the rinse time is up transition to the stop stage, and/or the grace period is over, turn the water off and exit the shower.

Again, personalized sound can be created and installed into the apparatus 100 via a personal computer and the USB port 540. Virtually any audio message can be created on the computer and transferred to the apparatus 100. Beeps, alarms, sirens, dogs barking, drums, musical cues, and even "record your own message" statements can be recorded via the personal computer via granted access to company website. Once customized and personalized on the website 850, the audio message can be transferred from the computer into the apparatus 100, via the USB port 540. It thereby resembles a personal app for the shower. For example, the apparatus can be able to tell the user's child in the user's own voice, such as "Henry, your sister's waiting, get out of the shower!!"

Figure 35:
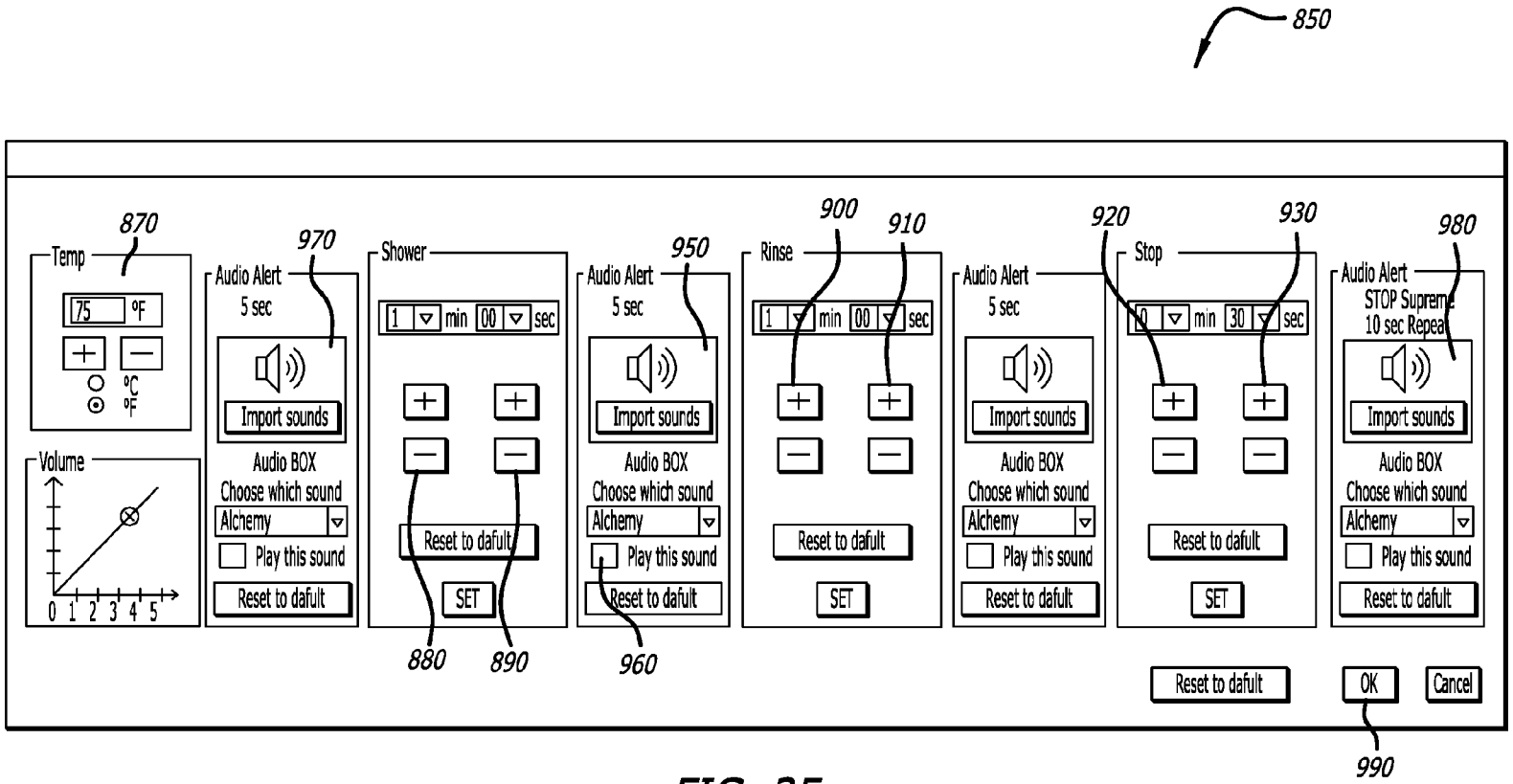
FIG. 35 is a screen shot of an operative page of a website which a user can use to program the display assembly of the apparatus.

With reference to FIG. 35, for example, further descriptions of the PC interface 850 to personalize the apparatus follow.

A. Customer Programs the Time:

1. Customer attaches a USB cable to a port 540 in the apparatus 100 and attaches the other end of his cable to his computer.

2. Computer talks with the apparatus 100 and takes guest/customer to Company (e.g., WaterSmartTechnology) websites: Program "iMShowerSmart"

3. Program syncs with the computer.

4. Customer clicks and increases or decreases temperature(s) to the desired temperature(s) 870.

5. Customer increases or decreases minutes for Shower (stage), by touching + or − icon 880.

6. Customer increases or decreases seconds for Shower, by touching + or − icon 890.

7. Customer increases or decreases minutes for Rinse (stage), by touching + or − icon 900.

8. Customer increases or decreases seconds for Rinse, by touching + or − icon 910.

9. Customer increases or decreases minutes for Shower (stage), by touching + or − icon 920.

10. Customer increases or decreases seconds for Shower, by touching + or − icon 930.

B. Customer Programs the Sound:

1. Customer selects sound effects, by highlighting the selection, pressing the play button to hear it, and if desired hitting the Import Sound tab 950 to import that sound effect into Audio Alert #1 then pressing the SET button.

2. Customer selects sound effects, by highlighting the selection, pressing the play button 960 to hear it, and if desired hitting the Import Sound tab 970 to import that sound effect into Audio Alert #2, then pressing the SET button.

3. Customer selects sound effects, by highlighting the selection, pressing the play button 960 to hear it, and if desired hitting the Import Sound tab 980 to import that sound effect into Audio Alert #3, then pressing the SET button.

4. Customer selects sound effects, by highlighting the selection, pressing the play button to hear it, and if desired hitting the Import Sound tab to import that sound effect into Audio Alert #4, then pressing the SET button.

Once all of the pre-sets have been loaded, the customer presses the OK button 990 and the data/programming is transferred to the computer program.

When the water reaches a pre-determined temperature it signals the audio deck, which can play the audio message selected. "Shower temperature has been reached" or whatever is chosen. Many people forget the shower is running, or wait long past its ready stage. There is a reminder, a nudge, pursuant to an aspect of this apparatus, such as "Hello! Shower's ready!" Thereby millions of gallons of hot water that otherwise would go directly down the drain can be saved.

An anti-theft chain (not shown) can also be added, to chain the apparatus 100 to the water supply pipe 110 (for example), thereby preventing theft of the apparatus such as when the apparatus is being used in public, non-residential locations.

Thus, the apparatus 100 can have one or more of the following advantages: shorten shower times; save energy; save water; slash carbon; extend the life of the boiler or water heater; reduce energy and extend the life of sewer systems and pumping equipment; reduce "water wars" among family members waiting for the shower; create general environmental awareness; create "shower courtesy" amongst people who share a shower stall; prompt users when the shower temperature is reached; and be a change agent, inspiring general conservation and environmental responsibility.

Accordingly, features of the present disclosure can include: built-in water generator to generate power to charge the battery of inside and supply to product; built-in temperature sensor to detect the water temperature; resettable buzzer volume by button and remote controller; resettable shower mode, rinse mode and stop mode time by remote controller; resettable initialization temperature setting by remote controller; rechargeable battery from micro USB from PC or most power and mobile power adapters; ten meter long range remote control; three colors LEDs for three types mode; easy install and uninstall; all settings (except buzzer volume resettable by remote and button) can use remote controller; and easy for the administrator to control and manage.

Exemplary specifications of the apparatus 100 can include Micro USB 5V 500MA Input voltage; 1050 mA/h polymer battery 350; a 3-phase motor; and 22 cm×7 cm×8.5 cm dimensions.

A battery voltage checking and charging capability can be included. For example, once the MUC (the controller of the PCBA) receives the Motor off trigger, the MCU checks the battery voltage. If the battery voltage ≥3.4V, the MCU goes into Stop Status. If the battery voltage <3.4V, LED4 flashes twice per second and there will be alert voice two seconds per thirty seconds, and this can last ten hours to alert the consumer to charge the battery. When the apparatus is charging from the USB port, the LED4 can be on during the charge and LED6 (e.g., FIG. 33) can be on once the charging is completed.

Figure 22:
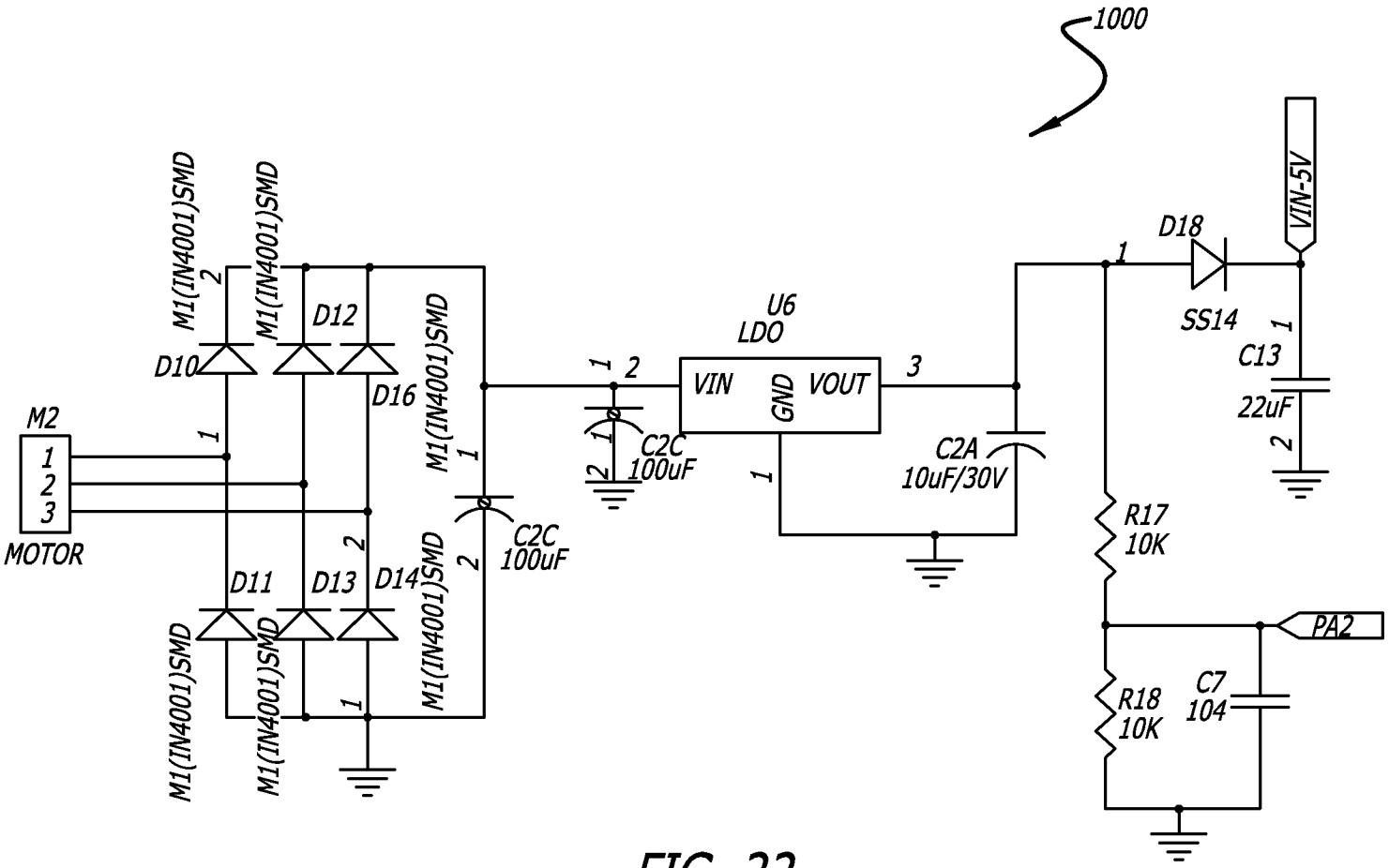
FIG. 22 is a detailed view taken on block A of the circuit of FIG. 21.
Figure 23:
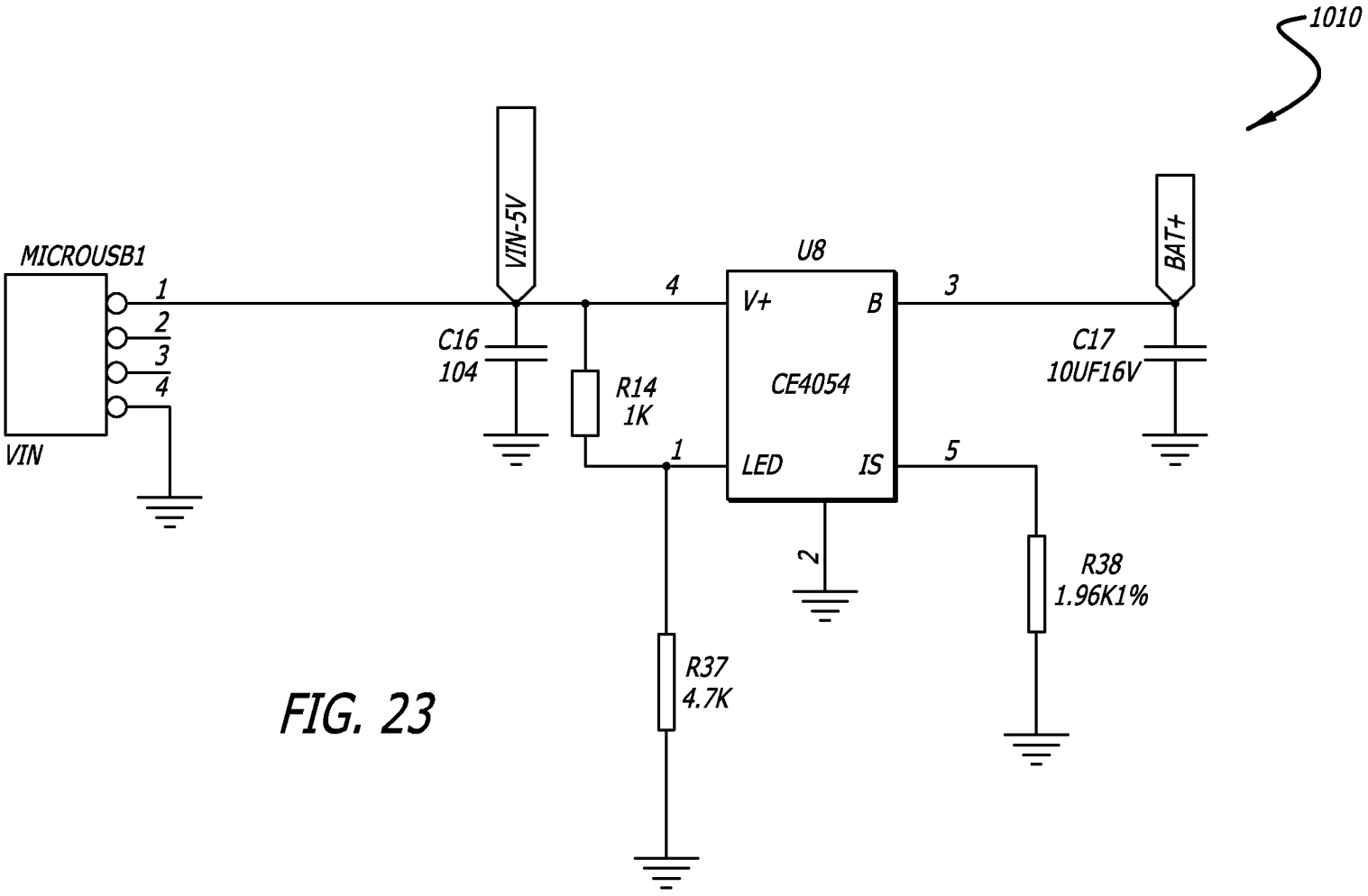
FIG. 23 is a detailed view taken on block B.
Figure 24:
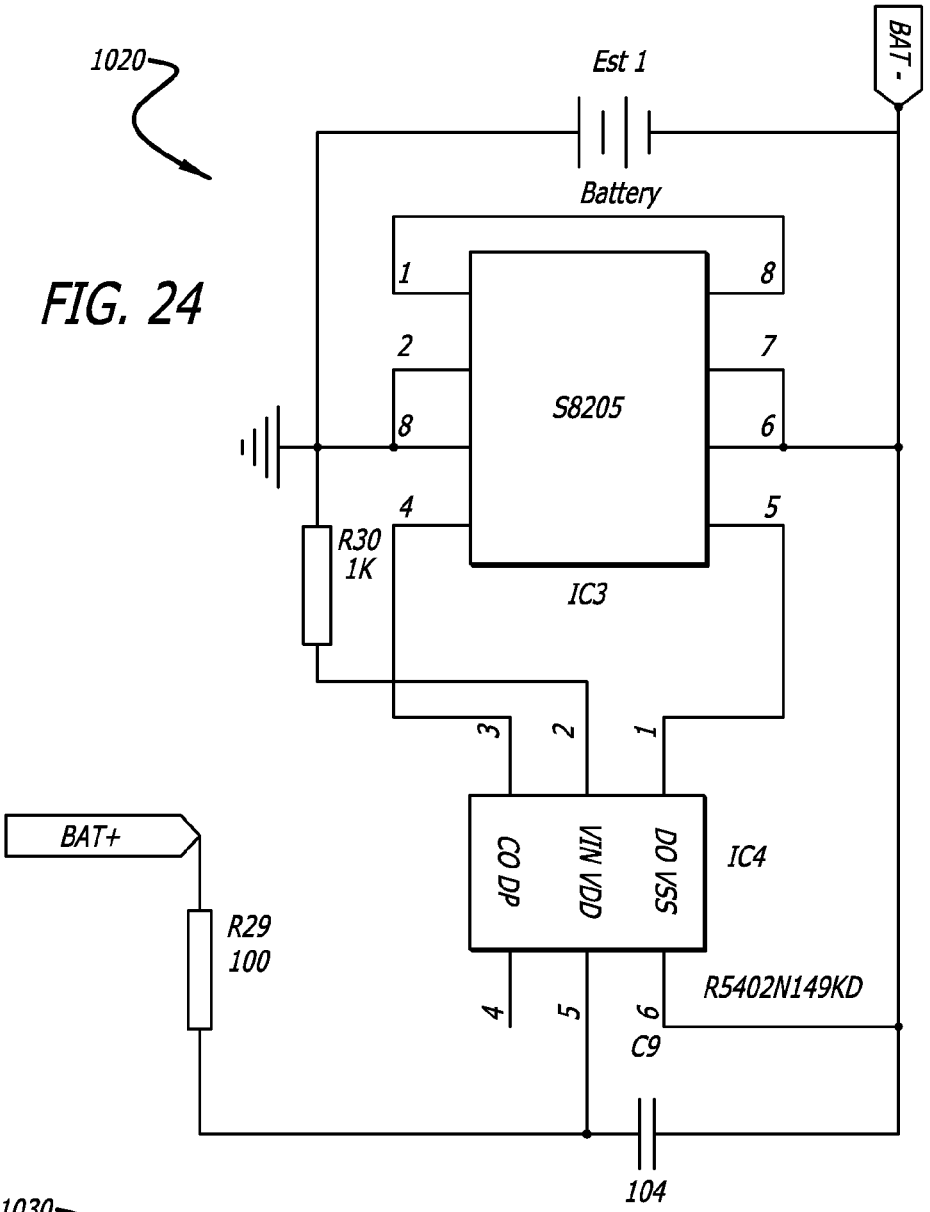
FIG. 24 is a detailed view taken on block C.
Figure 25:
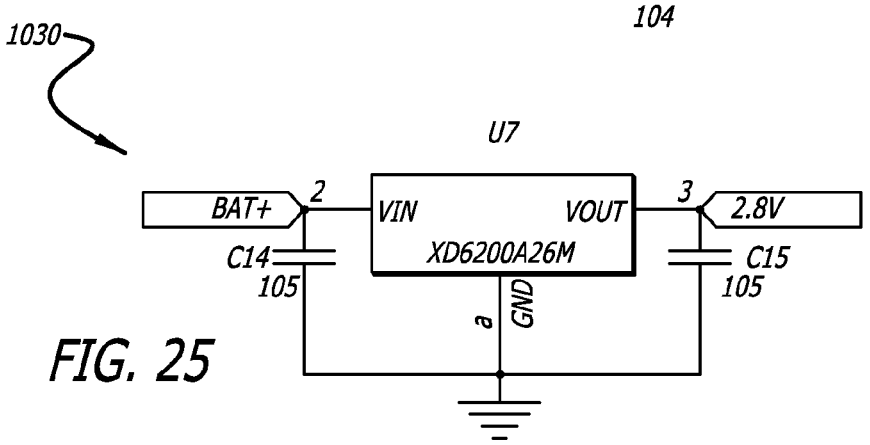
FIG. 25 is a detailed view taken on block D.

FIG. 21 is a circuit block diagram shown generally at 990 of the apparatus. FIG. 22 shows generally at 1000 the Dynamo motor power generation by water flow, namely three-phase AC is generated by the water flowing through the dynamo motor 210 is rectified, filtered and then stabilized to 5V DC by the DC To DC LDO. FIG. 23 shows generally at 1010 the battery charge control where power from the USB (Micro USB connector) 540 and the DC 5V rectifier (dynamo motor, see FIG. 22) are sent through that circuit that manages the charge cycle for the battery 250. FIG. 24 shows generally at 1020 a battery protection circuit that protects the battery 250 from charge and discharge shorts and over current protection. FIG. 25 shows generally at 1030 the voltage transformer wherein voltage from the battery 250 is transformed to 2.8V to supply the MCU, LEDs, audio function and IR receiver.

Figure 26:
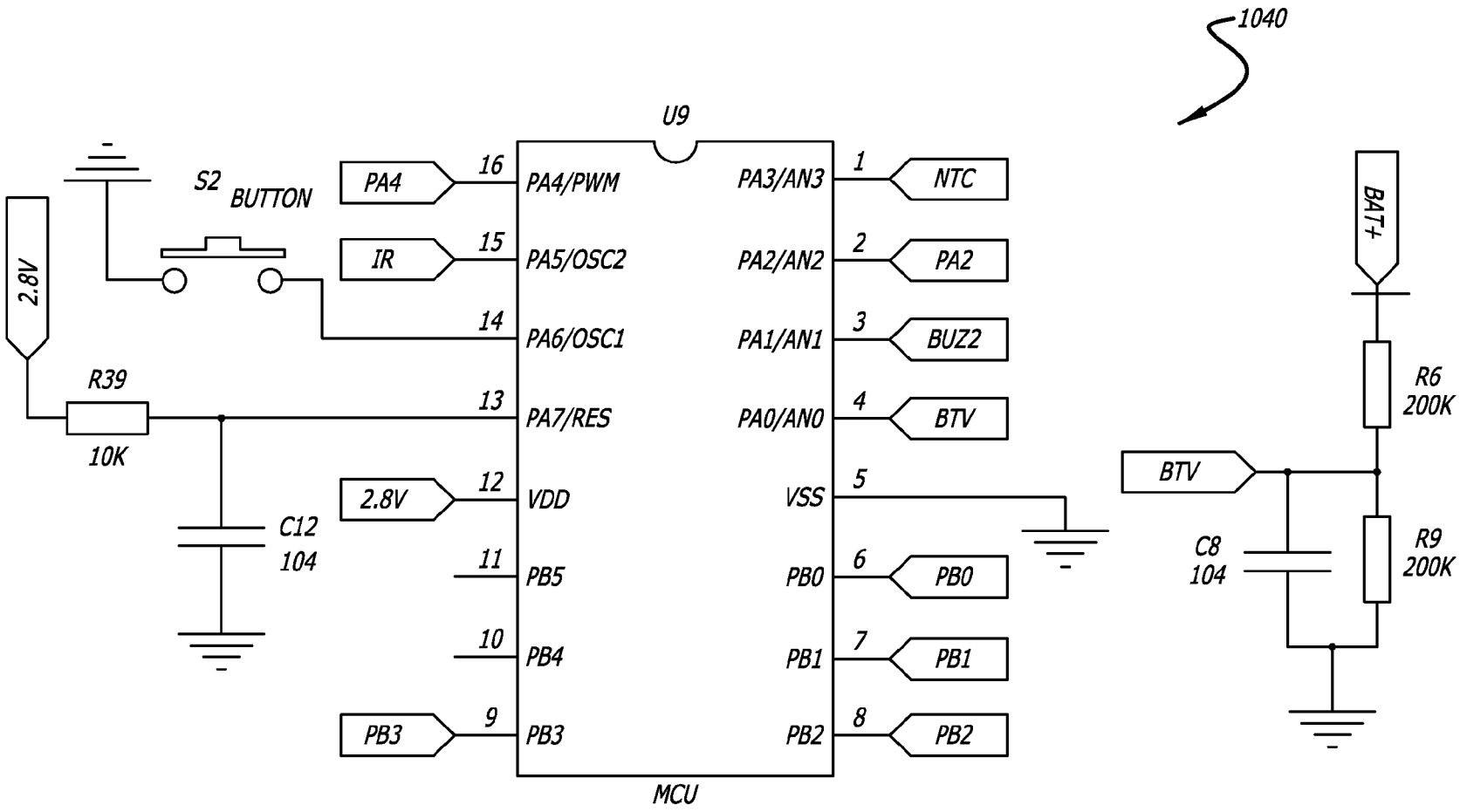
FIG. 26 is a detailed view taken on block E.
Figure 27:
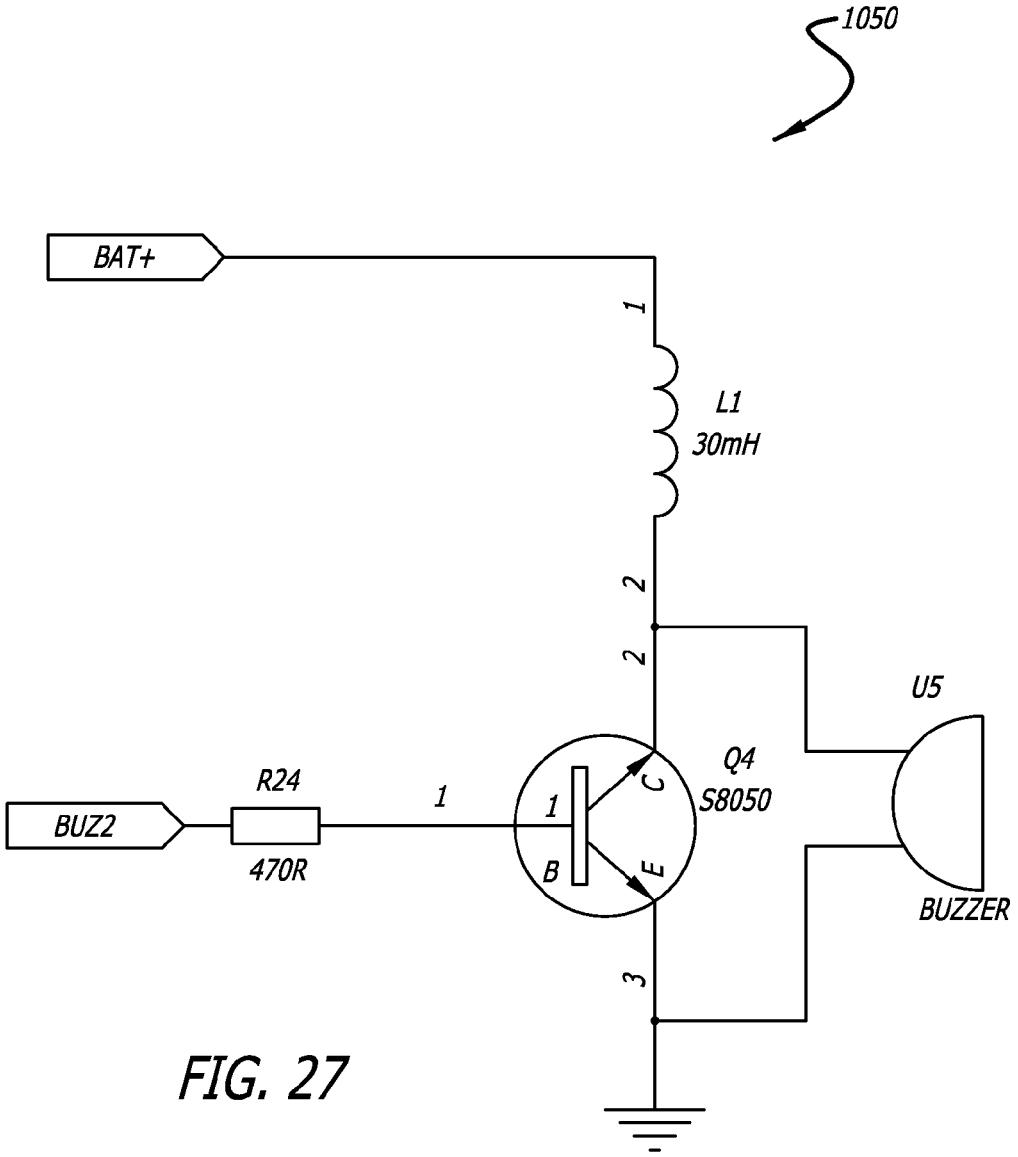
FIG. 27 is a detailed view taken on block F.
Figure 28:
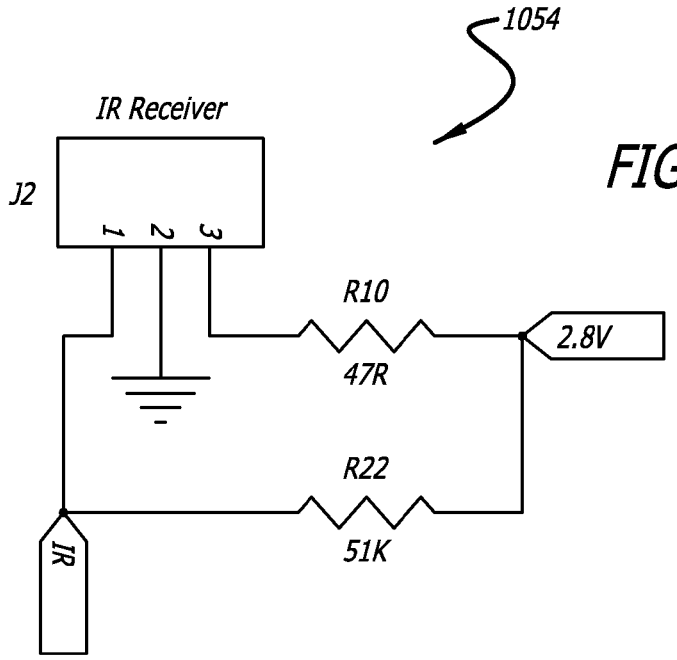
FIG. 28 is a detailed view taken on block G.
Figure 29:
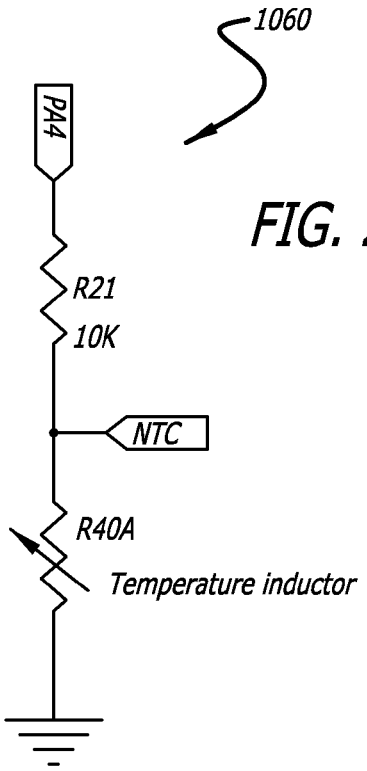
FIG. 29 is a detailed view taken on block H.
Figure 30:
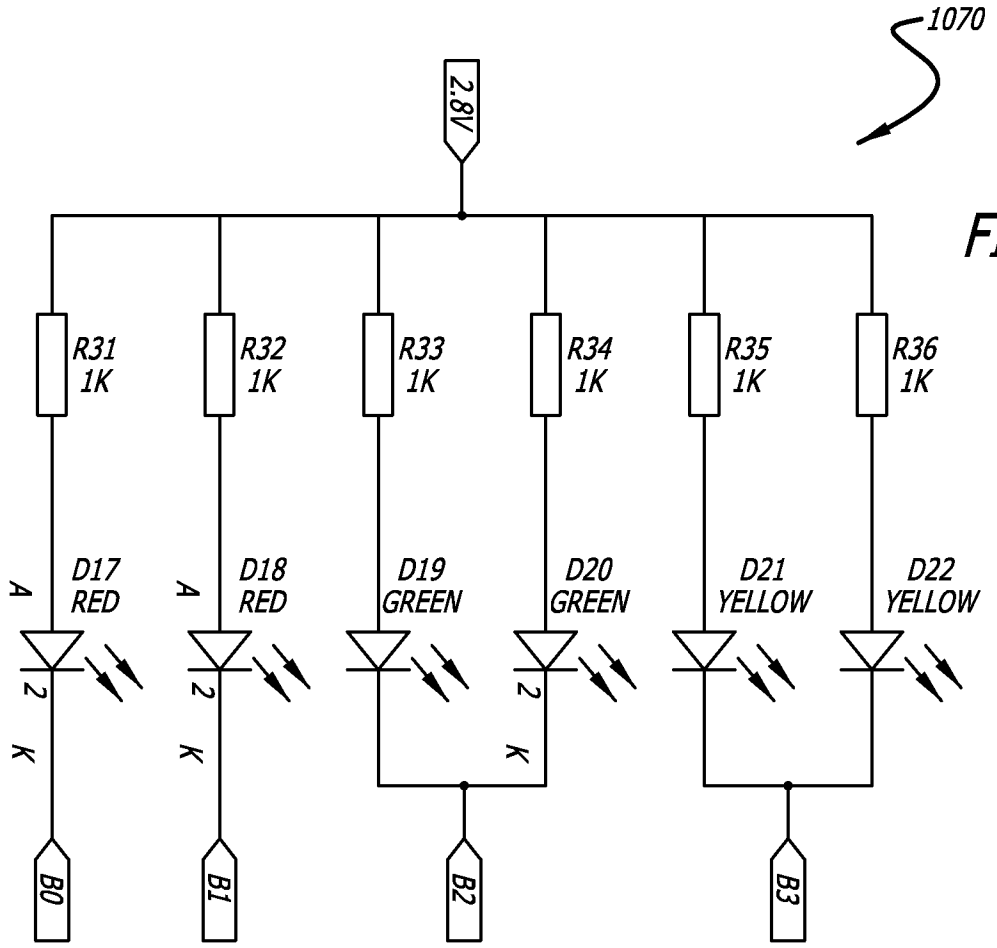
FIG. 30 is a detailed view taken on block I.

FIG. 26 shows generally at 1040 the processor, which is the main MCU that stores logic for controlling timing function, LED display, audio output, audio volume control, IR input, temperature detection and battery voltage detection and warning. FIG. 27 shows generally at 1050 the audio amplifier and buzzer for providing the user with audio feedback. FIG. 28 shows generally at 1054 the IR sensor to interface with the IR remote for adjusting operating parameters such as time and audio volume. FIG. 29 shows generally at 1060 the sensor for detecting the temperature of water flow. FIG. 30 shows generally at 1070 the LED inductor and the LED display that provides the user with visual feedback.

Figure 36:
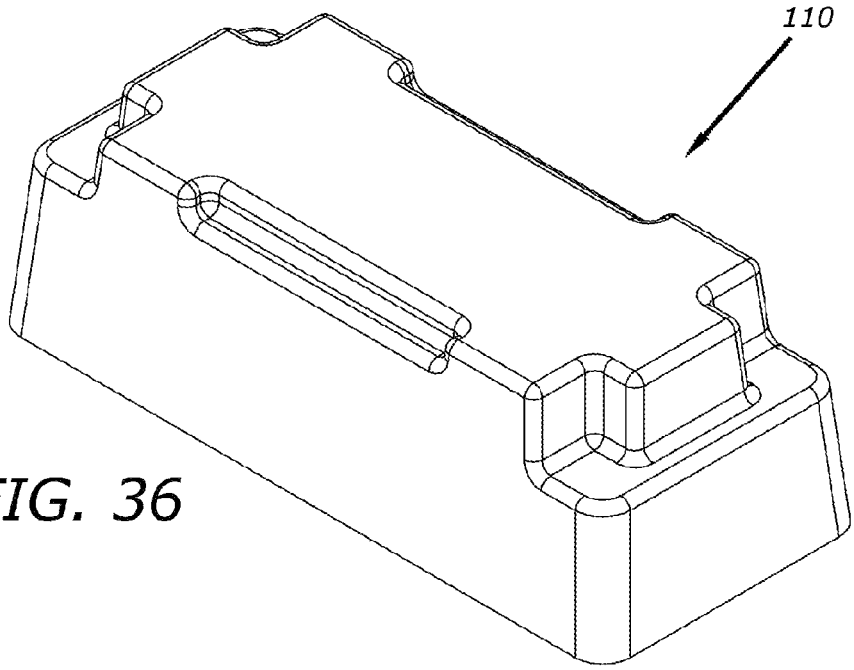
FIG. 36 is a top perspective view of a top portion of a packaging insert of the present disclosure for the apparatus.
Figure 37:
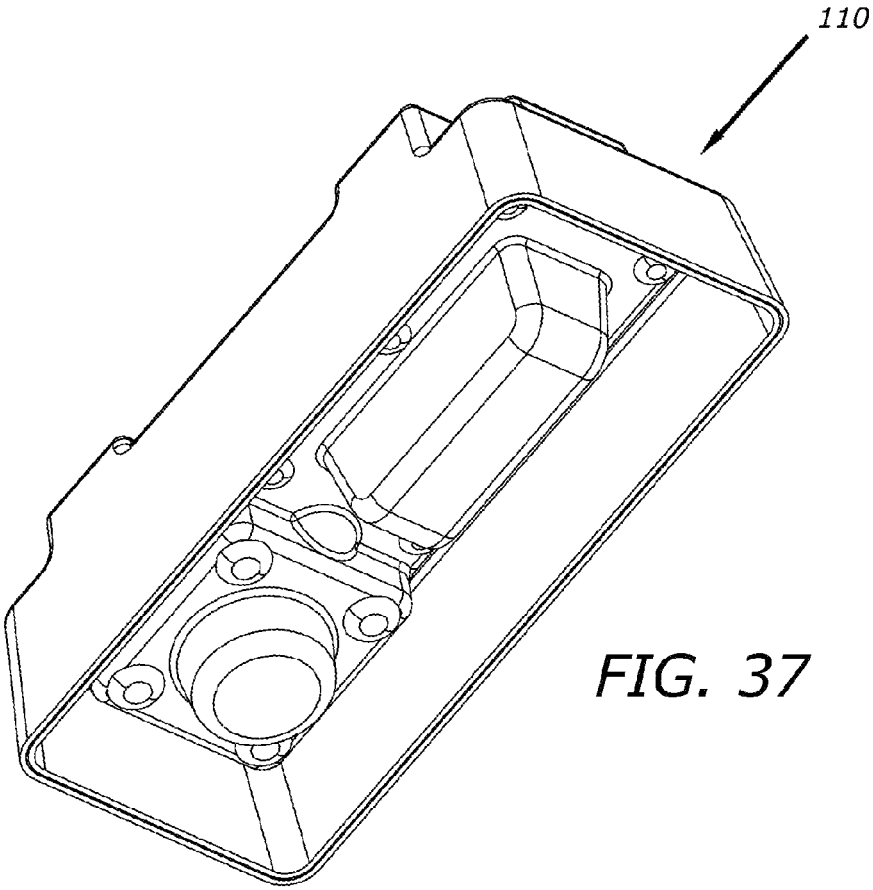
FIG. 37 is a bottom perspective view of the top portion of FIG. 36.
Figure 38:
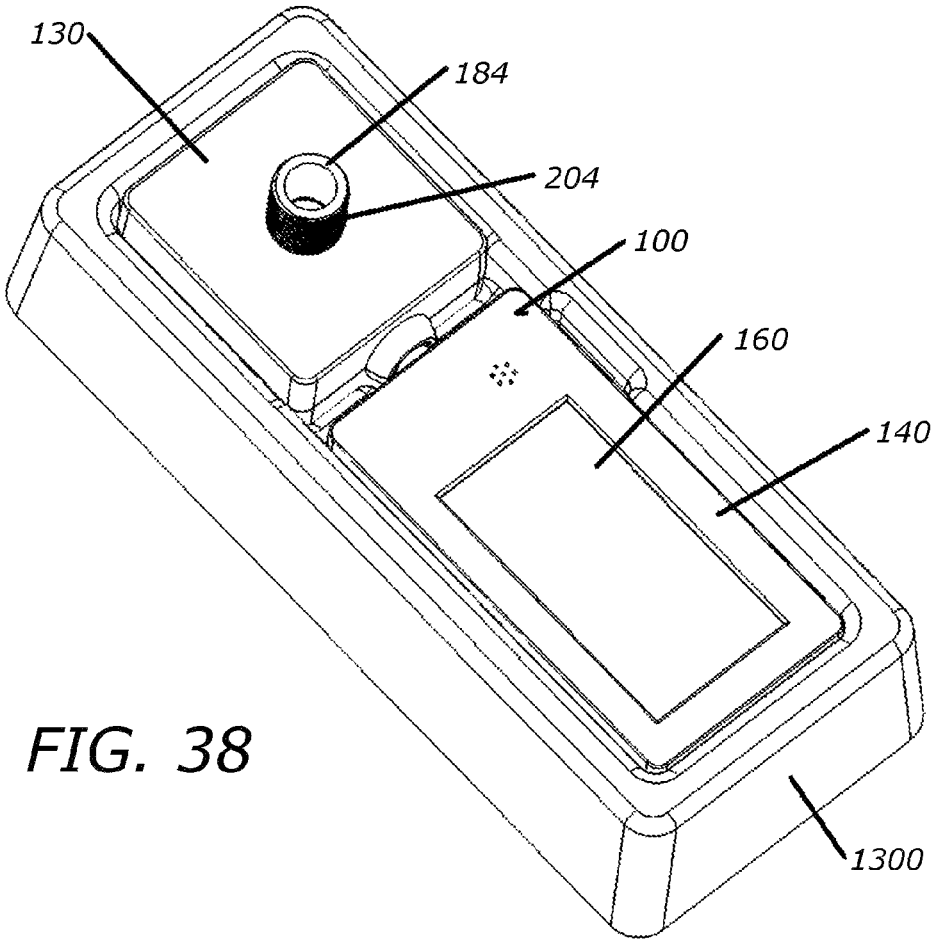
FIG. 38 is a top perspective view of a bottom portion of the packaging insert and showing the apparatus fitted therein.

FIG. 36 is a top perspective view of a top portion 1100 of a packaging insert for the apparatus 100. FIG. 37 is a bottom perspective view of the top portion 1100 of the packaging insert. And FIG. 38 is a top perspective view of a bottom portion 1300 of the packaging insert and showing the apparatus 100 fitted therein. The insert 1100, 1300 can be made from recycled paper and cardboard for sturdiness, and it can be form fitted to hold and protect the apparatus 100.

Thus, the apparatus 100 herein can include one or more of the following features: built-in dynamo generator to generate power from the water flow to the power unit; built-in temperature sensor to detect water temperature; user-programmable initialization temperature setting by remote controller; user programmable buzzer (via button or IR remote); user-programmable shower timer (rinse mode and stop mode times programmable by remote controller); rechargeable battery with auxiliary USB power input; IR remote with ten meter long range remote control, three color LEDs with three types of modes; and configuration/construction for easy installation and removal.

Further, some of the novel aspects of the apparatus 100 are: (1) Any audio (up to seven seconds worth, for example) can be downloaded and played back at pre-determined time intervals. Even the user's own voice (or that of family members, friends or even celebrities) can be downloaded and used. (2) The apparatus can be water activated and automatically started when the water flows into it. (3) The volume can be increased or decreased via a remote control or via a computer. (4) The time lengths for the Shower: Rinse: Stop stages can be changed (by the user) via remote control or a computer. (5) Once a pre-determined shower temperature has been reached a temperature sensor initiates the timing sequences. (6) Sound effects, voice recordings, time allotments, temperature start settings can be downloaded via a USB cable and/or from a personal computer to the computer program. (7) No (additional or replacement) batteries are needed since the apparatus is powered by a water flow/mini-hydro electric power plant. (8) The shower display screen is position-adjustable via a ball and socket. (9) The shower timer is water-powered, uses red-yellow-green lights and endless sound effects and is operatively positionable between the water supply line and the shower head.

The apparatus 100 thus shortens shower time, thereby saving money, water and energy while cutting CO2 emissions. It increases water and energy conservation habits in people of all ages. It can cut heating and sewer fees and shower times by three to five minutes thereby saving five to ten gallons of water per shower.

The foregoing description of exemplary aspects of the present teachings has been provided for purposes of illustration and description. Individual elements or features of a particular aspect of the present teachings are generally not limited to that particular aspect, but, where applicable, are interchangeable and can be used in other aspects, even if not specifically shown or described. The same may also be varied in many ways. Such variations are not to be regarded as a departure from the present teachings, and all such modifications are intended to be included within the scope of the present teachings. The present disclosure further includes sub-assemblies (such as the display unit itself and/or the power unit itself and/or the remote control unit itself), as well as methods of using and/or making and/or assembling and/or programming the apparatus and/or components thereof.

What is claimed is:

1. A shower apparatus comprising:

a power unit which includes: a water supply inlet adapted to be positioned in fluid communication with a water pipe; a water supply outlet adapted to be positioned in fluid communication with a shower head; and a water path between the inlet and the outlet;

a display unit which: is connected to the power unit; extends out from the power unit; has a display assembly configured to convey to a user information concerning water flowing in the water path; and receives electricity from the power unit;

the power unit including a hydroelectric power generator configured to be powered by water flowing along the water path and to generate the electricity;

a ball-and-socket joint connecting the display unit to the power unit and configured to allow the display unit to be moved in rotational and pivotal directions relative to the power unit;

the ball-and-socket joint including a first socket portion which is part of a first housing portion of the power unit, a second socket portion which is part of a second housing portion of the power unit, a first ball portion which is part of a first housing portion of the display unit, and a second ball portion which is part of a second housing portion of the display unit;

the power unit first and second housing portions being configured to be attached together with the first and second ball portions attached together and the attached ball portions positioned between the first and second socket portions; and the first and second housing portions of the power unit being configured to be detachable from one another to allow repair and/or replacement of at least one component of the power unit and subsequently re-attachable together by a user.

2. The shower apparatus of claim 1 wherein at least one wire passes through the ball-and-socket joint from the power unit to the display unit.

3. The shower apparatus of claim 2 wherein the at least one wire includes a wire which carries electricity and a wire which carries a water flow temperature signal to a controller of the display unit.

4. The shower apparatus of claim 1 wherein the display unit includes a battery charging circuit and a battery which powers the display assembly and is recharged by direct current from the battery charging circuit, and the power unit includes a hydroelectric power generator which generates and sends alternating current to the battery charging circuit.

5. The shower apparatus of claim 1 wherein the power unit includes a housing compartment having a proximal cover which includes the inlet on a face of the proximal cover and a distal cover which includes the outlet on a face of the distal cover, and wherein the inlet is a nipple with internal threads and the outlet is a nipple with external threads.

* * * * *